US007214461B2

(12) United States Patent
Yamashita et al.

(10) Patent No.: US 7,214,461 B2
(45) Date of Patent: May 8, 2007

(54) TONER FOR ELECTROPHOTOGRAPHY, DEVELOPER USING THE SAME, IMAGE-FORMING PROCESS CARTRIDGE USING THE SAME, IMAGE-FORMING APPARATUS USING THE SAME AND IMAGE-FORMING PROCESS USING THE SAME

(75) Inventors: Hiroshi Yamashita, Shizuoka (JP); Kenzo Tatsumi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 11/482,776

(22) Filed: Jul. 10, 2006

(65) Prior Publication Data

US 2006/0251984 A1 Nov. 9, 2006

Related U.S. Application Data

(62) Division of application No. 11/115,161, filed on Apr. 27, 2005, now Pat. No. 7,110,710, which is a division of application No. 10/392,894, filed on Mar. 21, 2003, now abandoned.

(30) Foreign Application Priority Data

Mar. 22, 2002 (JP) ..... 2002-081952

(51) Int. Cl.
*G03G 15/09* (2006.01)

(52) U.S. Cl. ..... 430/122; 399/282; 399/267; 399/276; 399/277

(58) Field of Classification Search ..... 430/122; 399/282, 111, 267, 276, 277
See application file for complete search history.

(56) References Cited

U.S. PATENT DOCUMENTS 4,511,239 A * 4/1985 Kanbe et al. ..... 399/138

(Continued)

FOREIGN PATENT DOCUMENTS

EP 1 239 334 9/2002

(Continued)

OTHER PUBLICATIONS

Grant, Roger et al. Chemical Dictionary. New York: McGraw-Hill, Inc. (1987) p. 148.*

(Continued)

*Primary Examiner*—Christopher Rodee
(74) *Attorney, Agent, or Firm*—Oblon, Spivak, McClelland, Maier & Neustadt, P.C.

(57) ABSTRACT

The toner of the present invention is suitably used in SLIC development system where a liner velocity of a developer-bearing member is 150 to 500 cm/sec. The toner has resin particles containing at least a coloring agent, and a charge controlling agent fine articles, and a ratio M/T of the amount M (% by weight) of an element in the surface of toner particles as determined by X-ray photoelectron spectroscopy (XPS) to the amount T (% by weight) of the element in the entire toner particles of 20 to 500, which element is present only in a charge control agent among components of the toner and is an element belonging to one of the first, second, third, fourth, and fifth periods of the long form of periodic table of elements except hydrogen, carbon, oxygen, and rare gas elements.

16 Claims, 6 Drawing Sheets

U.S. PATENT DOCUMENTS

| | | | | |
|---|---|---|---|---|
| 4,900,647 | A | 2/1990 | Hikake et al. | |
| 5,129,694 | A | 7/1992 | Tanimoto et al. | |
| 5,219,694 | A | 6/1993 | Anno et al. | |
| 5,350,657 | A | 9/1994 | Anno et al. | |
| 5,476,744 | A | 12/1995 | Anno | |
| 6,081,684 | A * | 6/2000 | Naganuma et al. | 399/277 |
| 6,085,062 | A | 7/2000 | Mizuishi et al. | |
| 6,128,449 | A | 10/2000 | Zenba et al. | |
| 6,140,000 | A | 11/2000 | Yamashita | |
| 6,144,811 | A | 11/2000 | Ohori et al. | |
| 6,144,822 | A | 11/2000 | Yamaguchi et al. | |
| 6,148,161 | A | 11/2000 | Usui et al. | |
| 6,171,743 | B1 | 1/2001 | Nakamura | |
| 6,255,028 | B1 | 7/2001 | Hasegawa et al. | |
| 6,266,501 | B1 | 7/2001 | Mizuishi et al. | |
| 6,360,068 | B1 | 3/2002 | Kinoshita et al. | |
| 6,403,275 | B1 | 6/2002 | Kuramoto et al. | |
| 6,416,914 | B1 | 7/2002 | Nakamura et al. | |
| 6,432,589 | B1 | 8/2002 | Uchinokura et al. | |
| 7,027,761 | B2 * | 4/2006 | Koetsuka et al. | 399/277 |
| 2001/0051270 | A1 | 12/2001 | Hiroshi et al. | |
| 2002/0028093 | A1 | 3/2002 | Miyoshi et al. | |
| 2002/0037467 | A1 | 3/2002 | Yohichiroh | |
| 2003/0039487 | A1 * | 2/2003 | Ikeguchi | 399/277 |
| 2003/0077536 | A1 | 4/2003 | Tamashita et al. | |
| 2006/0171745 | A1 * | 8/2006 | Hagiwara et al. | 399/267 |

FOREIGN PATENT DOCUMENTS

| | | | |
|---|---|---|---|
| JP | 2000112180 | A | 4/2000 |
| JP | 2001-27849 | | 1/2001 |

OTHER PUBLICATIONS

Degussa, Technical Information TI-1222 Special hydrophobic AEROSIL (SHA) for Toners. (Aug. 2001) p. 5.

* cited by examiner

TONER FOR ELECTROPHOTOGRAPHY, DEVELOPER USING THE SAME, IMAGE-FORMING PROCESS CARTRIDGE USING THE SAME, IMAGE-FORMING APPARATUS USING THE SAME AND IMAGE-FORMING PROCESS USING THE SAME

This application is a Divisional Application of U.S. application Ser. No. 11/115,161, filed on Apr. 27, 2005 now U.S. Pat. No. 7,110,710, allowed, which is a Divisional Application of U.S. application Ser. No. 10/392,894 filed on Mar. 21, 2003, abandoned.

BACKGROUND OF THE INVENTION

1. Field of the Invention

The present invention relates to a toner for use in electrophotographic systems such as copying machines and printers, to a developer comprising the toner of the present invention, to an image-forming process cartridge comprising the toner of the present invention therein, to an image forming apparatus comprising the toner of the present invention therein, and an image-forming process using the toner of the present invention.

2. Description of the Related Art

Copying, recording, printing, and other image forming apparatus form latent electrostatic images by an electrophotographic system and develop the latent electrostatic images using a developer. These apparatuses have been more and more resource saving, miniaturized, high-speed and digitized. Developers for use in these apparatuses must have higher quality with higher reliability. In addition, such miniaturized apparatus must be operated at a further higher speed, while an image density (image quality) must be ensured. As possible solutions to these problems, a technique of increasing the speed of a development sleeve, a technique of increasing the concentration of a toner, and a technique of narrowing a development gap are known. However, the technique of increasing the speed of a development sleeve invites increased scattering of toner particles. In the technique of increasing the concentration of a toner, a carrier has decreased constraining force with respect to the toner, and the toner cannot be satisfactorily transported to a development region, thus inviting scattering of toner particles or toner deposition on the background of images. In particular, when a toner is prepared by a melting, kneading and pulverizing method, it is difficult to satisfactorily control the average particle diameter of the resulting toner, a toner having a small average particle diameter cannot be significantly efficiently prepared, and the resulting toner is often dispersed non-uniformly and has a broad charge distribution. Accordingly, a problem arises in that the conventional toner prepared by the melting, kneading and pulverizing method often invites scattering of toner particles and toner deposition on the background of images when the speed of the development sleeve increases or the concentration of the toner increases.

FIG. 2 is a sectional view of an image-developer in a related art.

The image-developer includes a developer-bearing member 11 with magnetic flux density distribution curves 11-1 and 11-2 of an development main magnetic pole P1 and of a developer-transport pole P5 in normal direction, a scatter-preventing member 12 with an elastic member (inlet seal) 37*c* made of, for example, polyurethane adhered with a double-faced adhesive tape. The image-developer also includes a development doctor 13 for controlling the amount of the developer on the developer-bearing member 11, a puddle 14 for transporting the developer to the front of the image-developer, and a transport screw 15 for transporting the developer to the rear of the image-developer.

In the conventional image-developer, when a magnetic blush made of a chain of magnetic particles of the developer is formed or disintegrated by action of magnetic force of the developer transport pole P5 disposed downstream from the development doctor 13, a weakly charged toner becomes separated from the carrier and scatters as indicated by a broken arrow in a circle in FIG. 3. An import seal 12*a* prevents to some extent but not completely the toner that separated from the carrier from scattering out of the image-developer. This phenomenon significantly depends on adhesion between the toner and the carrier. With reference to FIG. 4, the toner 20 and the carrier 30 adhere to each other by the van der Waals force and the Coulomb force. Of the two forces, the adhesion mainly depends on the Coulomb force, and scattering of the toner often occurs when the toner has a low charge "q" and tends to become separated form the carrier. Accordingly, the scattering of the toner particles often occurs when weakly charged toner particles increase in proportions in a charge distribution of the toner.

With reference to FIG. 5, the carrier and the toner on the surface of the developer-bearing member are transported at a linear velocity $V=R\omega$, wherein V is the linear velocity, R is the radius of the developer-bearing member, and $\omega$ is the angular velocity of rotation. However, the linear velocity "v" of the tip of the magnetic blush is higher than "v" and is expressed by the equation: $v=(R+H)\omega$, wherein "H" is a distance between the surface of the developer-bearing member and the tip of the magnetic blush. Thus, also from the mechanical viewpoint, the toner tends to scatter when the magnetic blush made of a chain of magnetic particles of the developer is formed or disintegrated. Some of recent miniaturized and higher-speed apparatus have a linear velocity on the surface of a developer-bearing member of 300 mm/sec or more, and the scattering of the toner particles becomes a more and more significant problem.

The scattering of the toner particles has been described above by taking the developer-transport pole P5 as an example. In the sharp line contact development system (SLIC development system), an angle "$\alpha$" is set at 15° to 25°, wherein $\alpha$(hereinafter referred to as "half-width") is the angle formed between the rotational axis of the image carrier and a straight line between the points P and Q, wherein P and Q are each a point exhibiting a half value of the peak (maximum) value (gauss) with a point R exhibiting the peak value in the magnetic flux density distribution curve 11-1 of the development main magnetic pole P1 in FIG. 2. In the SLIC development system, the magnetic blush instantaneously forms and instantaneously disintegrates, and the linear velocity is higher than conventional equivalents. The scattering of the toner particles and toner deposition on the background of images in the development main magnetic pole P1 are significant problems.

SUMMARY OF THE INVENTION

Accordingly, an object of the present invention is to prevent scattering of toner particles from a developer-bearing member even in an image-developer which uses the developer-bearing member at a linear velocity of 150 mm/sec to 500 mm/sec.

Another object of the present invention is to prevent scattering of toner particles from a developer-bearing member even in an image-developer which uses the developer-bearing member at a linear velocity of 150 mm/sec to 500 mm/sec, and employs a sharp line contact (SLIC) development system having a narrow half-width of a development main magnetic pole and having a higher speed of chain formation of magnetic particles (magnetic blush formation).

Yet another object of the present invention is to prevent scattering of toner particles from a developer-bearing member even in an image-developer using a developer containing a toner with a toner concentration of 4% by weight or more.

A further object of the present invention is to prevent scattering of toner particles from a developer-bearing member even in an image-developer which uses a developer containing a toner with a toner a concentration of 4% by weight or more and employs a SLIC development system having a narrow half-width of a development main magnetic pole (P1) and having a higher speed of chain formation of magnetic particles.

The term "SLIC development system" as used herein means a system which has a development main magnetic pole (P1), a developer-transport pole (P5) upstream of a developer transport direction, and a developer-transport pole (P2) downstream of the developer transport direction on a developer-bearing member, in which the development main magnetic pole has the highest normal magnetic flux density among the three poles and a half width of 25 degrees or less.

Specifically, the present invention provides, in the first aspect, a toner for electrophotography comprising a resin particle containing a coloring agent, and a charge control agent particle which is mixed with the resin particle so as to form a toner particle of the toner, in which a ratio M/T of the amount M (% by weight) of an element in the surface of toner particles as determined by X-ray photoelectron spectroscopy (XPS) to the amount T (% by weight) of the element in the entire toner particles of 20 to 500, which element is present only in a charge control agent among components of the toner and is an element belonging to one of the first, second, third, fourth, and fifth periods of the long form of periodic table of elements except hydrogen, carbon, oxygen, and rare gas elements.

In the second aspect, the present invention provides a toner for electrophotography comprising a resin particle containing at a coloring agent, and a charge control agent particle, in which the resin particles containing the coloring agent are prepared by dissolving or dispersing a toner composition including at least a binder resin and the coloring agent in an organic solvent to yield a toner compound-dissolved solvent or a toner compound-dispersed solvent, the toner compound-dissolved solvent or the toner compound-dispersed solvent is dispersed in a water-based medium to thereby yield an emulsion, and removing the solvent from the emulsion. Thereafter, the resin particle and the charge controlling agent particle are mixed to yield a particle of the toner.

In the third aspect, the present invention provides a toner for electrophotography which has the identical characteristics of both the first aspect of the toner for electrophotography, and the second aspect of the toner for electrophotography.

The toners for electrophotography of the present invention can be advantageously used in an image-developer including at least a development main magnetic pole on a developer-bearing member and using the developer-bearing member at a linear velocity of 150 mm/sec to 500 cm/sec without scattering of toner particles from the developer-bearing member.

The present invention provides a developer used as a single-component developer, which comprises any one of the toners of the present invention. Moreover, the present invention provides a developer used as a double-component developer, which comprises any one of the toners of the present invention.

The present invention further provides an image-forming apparatus comprising a latent electrostatic image support, an image-developer which contains a developer comprising any one of the toners of the present invention, and a developer-bearing member which has a development sleeve on an outermost layer surface of the developer, and carries the developer on the surface. The development sleeve has at least a main magnetic pole for forming magnetic brushes with the toner, where the latent electrostatic image support and the development sleeve come to close to each other with the shortest distance. Further, the development sleeve has a point "A" on a surface thereof and on a normal based on the main magnetic pole, and has a point "B" being 1 mm distant from the point "A" in a direction of the normal to the surface thereof. In this case, the point "B" has an attenuated magnetic flux density of 0 to 40 with respect to a magnetic flux density of 100 on the point "A". Furthermore, the main magnetic pole has a half-width, namely an angle formed between points on a magnetic flux density distribution curve of the main magnetic pole and at half value of a maximum magnetic force of the main magnetic pole, is 5° to 20°. The developer is transported at a liner velocity of 150 mm/sec to 500 mm/sec.

The present invention yet provides an image-forming process using the toner for electrophotography of the present invention in the image-forming apparatus of the present invention.

In addition and advantageously, the present invention provides an image-forming process cartridge comprising the toner for electrophotography of the present invention as a developer.

The toners of the present invention can effectively prevent scattering of the toner from the developer-bearing member and can yield very high quality images in any of image-developers that are used at a linear velocity of the developer-bearing member of 150 mm/sec to 500 mm/sec, those used in the SLIC development system in which magnetic blush forms at a higher speed than conventional developer-bearing members, and those used at a toner concentration in a developer of 4% by weight or more.

Further objects, features and advantages of the present invention will become apparent from the following description of the preferred embodiments with reference to the attached drawings.

Figure 1:
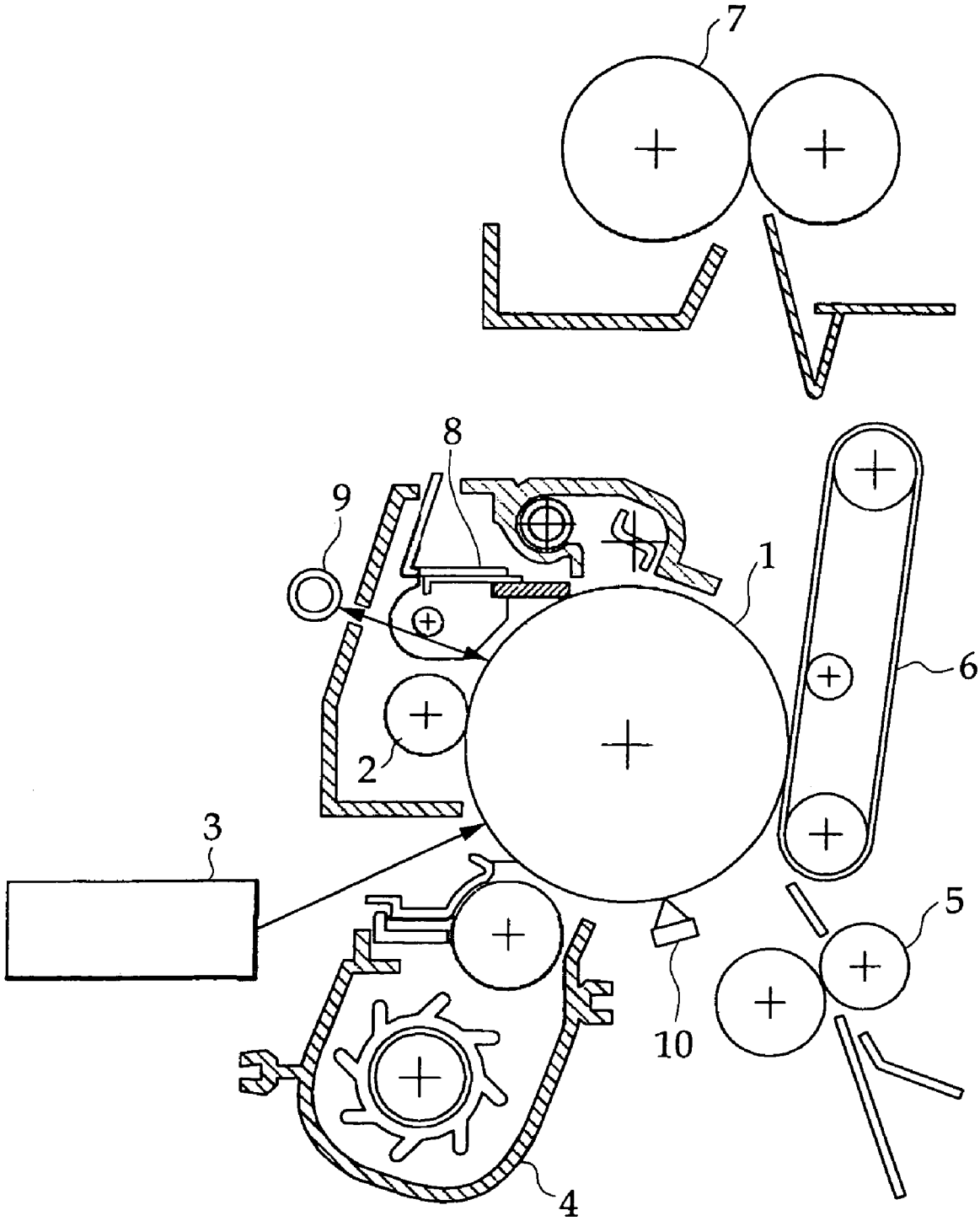
FIG. 1 is a sectional view showing an example of the image forming apparatus of the present invention.
Figure 2:
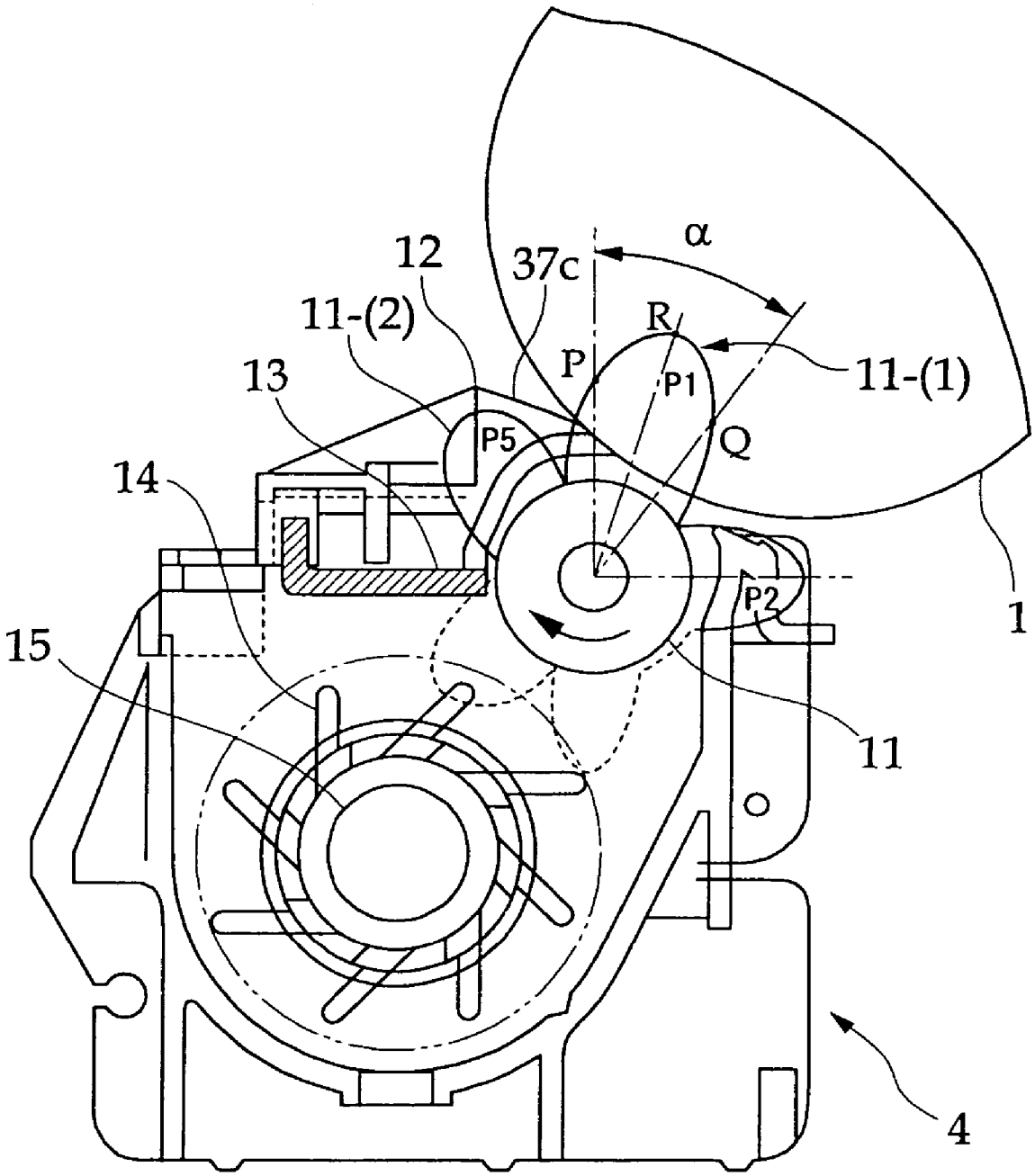
FIG. 2 is a sectional view of a conventional image forming apparatus.
Figure 3:
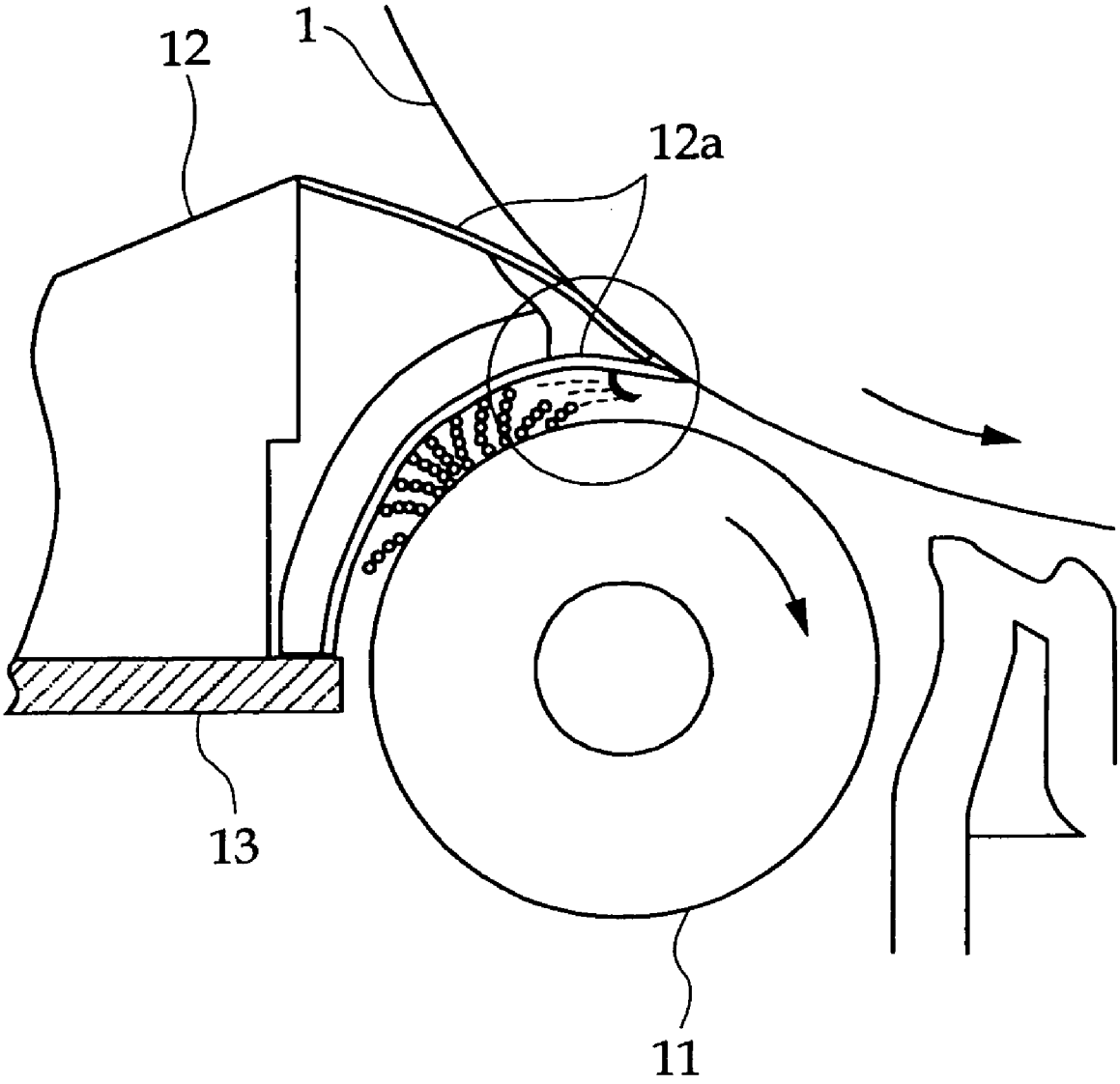
FIG. 3 is an enlarged view of an image-developer of the image forming apparatus of FIG. 2.
Figure 4:
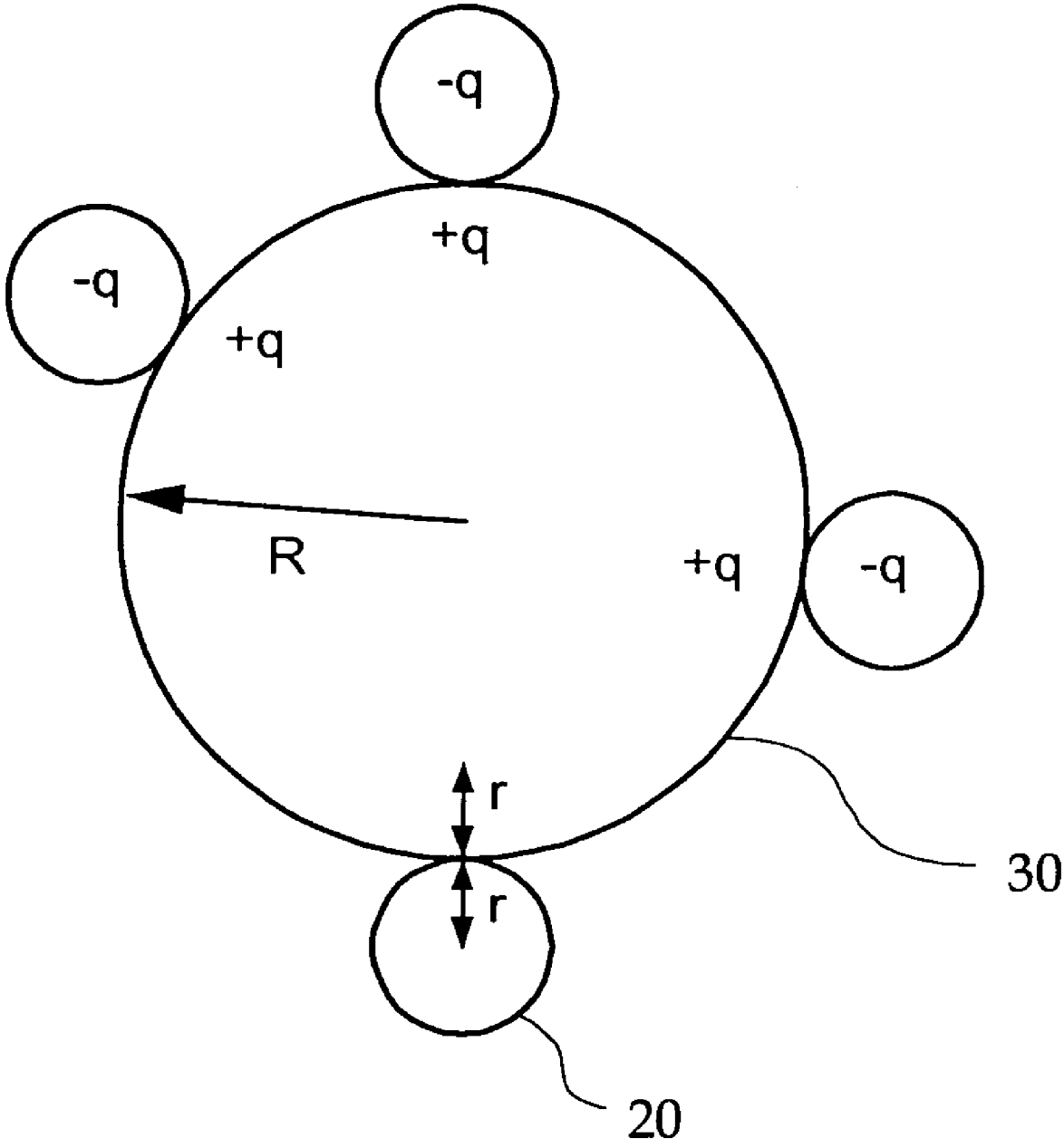
FIG. 4 is a diagram showing an example of toner adhesion to a carrier.
Figure 5:
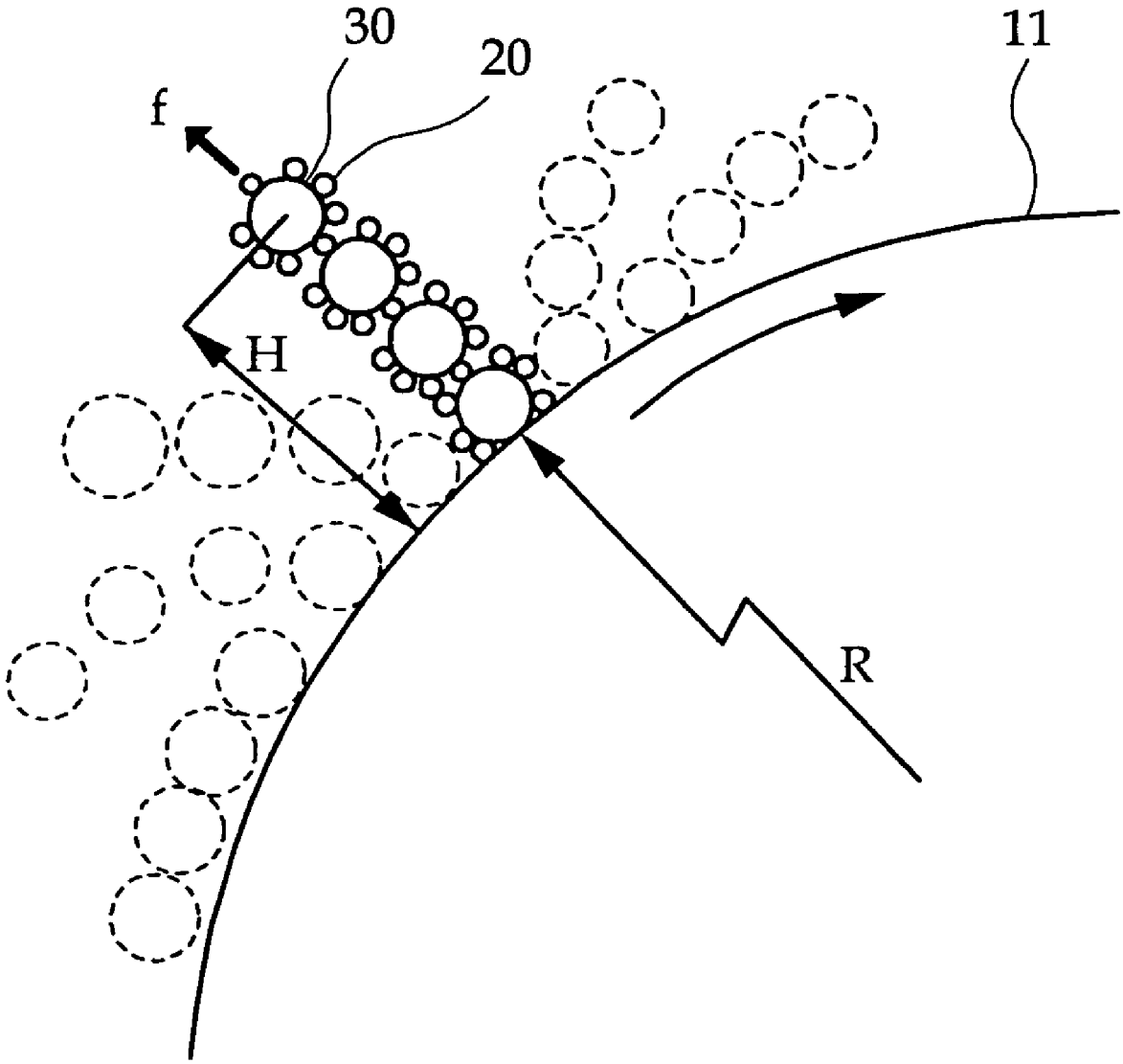
FIG. 5 is another diagram showing an example of the toner adhesion to the carrier.

DESCRIPTION OF THE PREFERRED EMBODIMENTS (Toner for Electrophotography)

In the toner for electrophotography of the present invention, the amount of an element in the surface of toner particles and the amount of the element in the entire toner particles are controlled, which element is present only in a charge control agent among components of the toner and is an element belonging to one of the first, second, third, fourth, and fifth periods of the long form of periodic table of elements except hydrogen, carbon, oxygen, and rare gas elements. In other words, the toner for electrophotography of the present invention has a ratio of the amount of the charge control agent in the surface of the toner to the amount of the charge control agent in the entire toner particles controlled within a specific range. In addition or alternatively, the toner for electrophotography of the present invention comprises a mixture of resin particles at least containing a coloring agent and a binder resin, and charge control agent particles. Accordingly, the toners for electrophotography of the present invention are typically useful in an image-developer that can keep its high image quality even at a high speed and is used with a developer containing a toner in a concentration of 4% by weight or more. The toners are typically advantageously used in a SLIC development system that exhibits a high-speed magnetic blush formation and can yield high-quality images.

(Determination of Surface Element)

It is significantly important for the charge control agent particles to be present in the surface of toner particles in a specific amount or more, when the linear velocity of the development unit is high, the SLIC development system is used, or the toner concentration is high. The amount of the charge control agent particles in the surface of the toner particle can be converted into the amount of an element which is characteristic to the charge control agent particles. The amount of the element in the surface of each of the toner particles is determined by electron spectroscopy for chemical analysis (ESCA) (X-ray photoelectron spectroscopy; XPS) using, for example, a PHI Model 1600S X-ray photoelectron spectroscope (available from Physical Electronics, Inc.). In the XPS, Mg K$\alpha$ line radiation is provided as an X-ray source at an output of 200 W. Toner particles are scattered within an analysis area of 0.8 mm wide 2.0 mm long, so as to be analyzed. Based on measured peak intensities of elements, the concentration of an element in the surface of the toner particle characteristic to the charge control agent particles (for example, an element that is not contained in other components such as a coloring agent particles, excluding C, O, and N) is expressed by "% by element" (atomic %), using a relative sensitivity factor available from Physical Electronics, Inc. The amount M (% by weight) of the specific element in the surface is determined according to the following equation:

$$M\ (\%\ \text{by weight}) = [(\text{Atomic \% of the specific element}) \times (\text{Atomic weight of the specific element}) / \Sigma[(\text{Atomic \% of a measured element}) \times (\text{Atomic weight of the measured element})]$$

(Determination of Charge Control Agent in An Entire Portion of the Toner Particle)

The amount of the specific element in the charge control agent particles in the entire portion of toner particle can be determined by X-ray fluorescence analysis. For example, 3 g of sample toner particles are molded into a 40 mm pellet in diameter using a tablet molding machine at a pressure of 10 t/cm$^2$ and is analyzed using a wavelength dispersive X-ray spectrometer (available from Rigaku Corporation under the trade name of RIX 3000). Preferably, a calibration curve on peak intensity of the specific element of the charge control agent particles has been plotted using a toner containing the charge control agent particles in a set amount. The content "T" of the element in the entire portion of the toner particle is expressed by "% by weight."

The ratio M/T in the present invention substantially expresses the ratio of the amount of the charge control agent particles in the surface of the toners to the amount of the charge control agent particles in the entire portion of toner particle. The ratio M/T is preferably from about 20 to about 500, and more preferably from 40 to 300. If the ratio is less than 20, the charge amount may be low and charge speed may be slow, which prevents toners from being transported in a developing unit with a high speed. If it is 500 or more, a toner may be excessively charged, the charge distribution may become broad to thereby fail to produce high-quality images. In addition, pollution to other members that contact with the toner may become more obvious.

The toner for use in the present invention may be prepared by the following manner. A modified polyester or a mixture of a modified polyester and an unmodified polyester is used as a binder resin; a toner particle comprising the binder resin and a coloring agent is dissolved or dispersed in an organic solvent to yield a solution or a dispersion; the solution or dispersion is dispersed in a water-based medium to yield an emulsion, and the solvent is removed from the emulsion and thereby yields resin particles containing the coloring agent. The resin particles are then mixed with charge control agent particles and thereby yield a toner. According to this process, a toner comprising small particles can be efficiently produced, and the resulting toner is uniformly dispersed and has a very uniform charge distribution and can thereby yield very good images, even if utilized in an image-developer that is operated at a high speed or in a toner concentration of 4% by weight or more.

The amount of the charge control agent particles on the surface of the resin particle can be controlled by appropriately controlling the amount of the charge control agent particles, the rotation speed of a rotator of a mixer, the mixing time, and other conditions in mixing of the resin particles with the charge control agent particles. The toner particle, having the resin particles that have the charge control agent particles on the surface thereof in a controlled amount to give the above-specified M/T ratio, can yield further satisfactory images.

Materials and preparation thereof for the toners for electrophotography of the present invention will be described in more detail hereinafter.

(Modified Polyesters)

The term "modified polyester" as used herein means and includes a polyester obtained by allowing the polyester to react with another compound having a functional group by action of a hydroxyl group, an acid group and/or another residual functional group in the polyester.

Examples of the modified polyesters include, but are not limited to, polyesters (i) modified with a urea bond, such as reaction products between a polyester prepolymer (A) having an isocyanate group and amine (B). Examples of the isocyanate-containing polyester prepolymers (A) include reaction products of a polyester with a polyisocyanate (3), in which the polyester is a polycondensation product between a polyol (1) and a polycarboxylic acid (2) and has a group having an active hydrogen. Examples of the groups having active hydrogens of the polyester include those in hydroxyl groups such as alcoholic hydroxyl group and phenolic hydroxyl group, amino group, carboxyl group, mercapto group, and the like. Among them, alcoholic hydroxyl group is preferred.

Examples of the polyol (1) includes, but is not limited to, diols (1-1) and trihydric and higher polyols (1-2). The polyol (1) is preferably a diol (1-1) alone or in combination with a small amount of a polyol (1-2). The diols (1-1) include, but are not limited to, alkylene glycols such as ethylene glycol, 1,2-propylene glycol, 1,3-propylene glycol, 1,4-butanediol, and 1,6-hexanediol, or the like; alkylene ether glycols such as diethylene glycol, triethylene glycol, dipropylene glycol, polyethylene glycol, polypropylene glycol, and polytetramethylene ether glycol; alicyclic diols such as 1,4-cyclohexanedimethanol, and hydrogenated bisphenol A; bisphenols such as bisphenol A, bisphenol F, bisphenol S, or the like; ethylene oxide, propylene oxide, butylene oxide, and other alkylene oxide adducts of the alicyclic diols; ethylene oxide, propylene oxide, butylene oxide, or the like.

Among these diols, preferred are alkylene glycols containing 2 to 12 carbon atoms and alkylene oxide adducts of bisphenols. Of these, alkylene oxide adducts of bisphenols alone or in combination with alkylene glycols containing 2 to 12 carbon atoms are particularly preferred. The trihydric or higher polyols (1-2) include, but are not limited to, trihydric to octavalent, or higher polyhydric aliphatic alcohols such as glycerol, trimethylolethane, trimethylolpropane, pentaerythritol, sorbitol, or the like; trihydric or higher phenols such as trisphenol PA, phenol novolak, cresol novolak, or the like; and alkylene oxide adducts of the trihydric or higher polyphenols.

Examples of the polycarboxylic acid (2) include dicarboxylic acids (2-1) and trihydric or higher polycarboxylic acids (2-2). As the polycarboxylic acid (2), using a dicarboxylic acid (2-1) alone or in combination with a small amount of the trihydric or higher polycarboxylic acid is preferred. Examples of the dicarboxylic acids (2-1) include, but are not limited to, alkylenedicarboxylic acids such as succinic acid, adipic acid, sebacic acid, or the like; alkenylenedicarboxylic acids such as maleic acid, fumaric acid, or the like; aromatic dicarboxylic acids such as phthalic acid, isophthalic acid, terephthalic acid, naphthalenedicarboxylic acid, or the like.

Among these dicarboxylic acids, the preferred are alkenylenedicarboxylic acids each containing 4 to 20 carbon atoms and aromatic dicarboxylic acids each containing 8 to 20 carbon atoms. Examples of the trihydric or higher polycarboxylic acids (2-2) include aromatic polycarboxylic acids each containing 9 to 20 carbon atoms, such as trimellitic acid, pyromellitic acid, or the like. An acid anhydride or lower alkyl ester such as methyl ester, ethyl ester, isopropyl ester, or the like, of any of the polycarboxylic acids can be used as the polycarboxylic acid (2) to react with the polyol (1).

The ratio of the polyol (1) to the polycarboxylic acid (2) in terms of the equivalence ratio [OH]/[COOH] of the hydroxyl group [OH] to the carboxyl group [COOH] is from 2/1 to 1/1, preferably from 1.5/1 to 1/1, and more preferably from 1.3/1 to 1.02/1.

Examples of the polyisocyanate (3) include, but is not limited to, aliphatic polyisocyanates such as tetramethylene diisocyanate, hexamethylene diisocyanate, 2,6-diisocyanatemethylcaproate, or the like; alicyclic polyisocyanates such as isophorone diisocyanate, cyclohexylmethane diisocyanate, or the like; aromatic diisocyanates such as tolylene diisocyanate, diphenylmethane diisocyanate, or the like; aromatic-aliphatic diisocyanates such as $\alpha,\alpha,\alpha',\alpha'$-tetramethylxylylene diisocyanate, or the like; isocyanurates; block polymers of the polyisocyanates having blocks, for example, phenol derivatives, oximes, caprolactams, or the like; and mixtures of these examples.

The amount of the polyisocyanate (3) in terms of the equivalence ratio [NCO]/[OH] of an isocyanate group [NCO] to a hydroxyl group [OH] of the polyester is from 5/1 to 1/1, preferably from 4/1 to 1.2/1, and more preferably from 2.5/1 to 1.5/1. If the ratio [NCO]/[OH] is more than 5, image-fixing properties at low temperatures may deteriorate. If a molar ratio of the [NCO] is less than 1, the urea content in the modified polyester may decrease and thereby hot offset-resistance may deteriorate. The content of the polyisocyanate (3) in the prepolymer (A) having an isocyanate group at its end is from 0.5% by weight to 40% by weight, preferably from 1% by weight to 30% by weight, and more preferably from 2% by weight to 20% by weight. If the content is less than 0.5% by weight, the hot off-set resistance may deteriorate, and satisfactory heat-resistance storageability and image-fixing properties at low temperatures may not be attained compatibly. If the content is more than 40% by weight, the image-fixing properties at low temperatures may deteriorate.

The prepolymer (A) generally has, on average, 1 or more, preferably 1.5 to 3, and more preferably 1.8 to 2.5 isocyanate groups per molecule. If the amount of the isocyanate group per molecule is less than 1, the urea-modified polyester may have a low molecular weight and the off-set resistance may deteriorate.

Examples of the amine (B) includes diamines (B1), trihydric or higher polyamines (B2), amine alcohols (B3), aminomercaptans (B4), amino acids (B5), and block polymers (B6) having amino groups of (B1) to (B5) as blocks. Examples of the diamines (B1) include, but are not limited to, aromatic diamines such as phenylenediamine, diethyltoluenediamine, 4,4'-diaminodiphenylmethane, or the like; alicyclic diamines such as 4,4'-diamino-3,3'-dimethyldicyclohexylmethane, diaminocyclohexanes, isophoronediamine, or the like; and aliphatic diamines such as ethylenediamine, tetramethylenediamine, hexamethylenediamine, or the like. Examples of the trihydric or higher polyamines (B2) include diethylenetriamine, triethylenetetramine, and the like. Examples of the amino alcohols (B3) include, but are not limited to, ethanolamine, hydroxyethylaniline, and the like. Examples of the aminomercaptans (B4) include aminoethyl mercaptan, aminopropyl mercaptan, and the like. Examples of the amino acids (B5) include, but are not limited to, aminopropionic acid, aminocaproic acid, and the like. Examples of the block polymers (B6) having amino groups of (B1) to (B5) as blocks, includes ketimine compounds and oxazoline compounds derived from the amines (B1) to (B5) and ketones such as acetone, methyl ethyl ketone, methyl isobutyl ketone, or the like. Among these amines (B), the preferred is using the diamines (B1) alone or in combination with a small amount of the polyamines (B2).

If necessary, the molecular weight of the urea-modified polyester can be controlled by using an elongation terminator. Examples of the elongation terminators include, but are not limited to, monoamines such as diethylamine, dibutylamine, butylamine, laurylamine, or the like; and block polymers (e.g., ketimine compounds) of these monoamines.

The content of the amine (B) in terms of the equivalence ratio [NCO]/[NHx] of an isocyanate group [NCO] in the prepolymer (A) to an amino group [NHx] of the amine (B) is generally from 1/2 to 2/1, preferably from 1.5/1 to 1/1.5 and more preferably from 1.2/1 to 1/1.2. If the ratio [NCO]/[NHx] is more than 2/1 or is less than 1/2, the urea-modified polyester (i) may have a low molecular weight, and the hot off-set resistance may deteriorate. The urea-modified polyester (i) for use in the present invention may have a urethane bond in addition to the urea bond. The molar ratio of the urea bond to the urethane bond is from 100/0 to 10/90, preferably from 80/20 to 20/80, and more preferably from 60/40 to 30/70. If the molar ratio of the urea bond to the urethane bond is less than 10/90, the hot off-set resistance may deteriorate.

The urea-modified polyester (i) for use in the present invention is prepared by a one-shot process or a prepolymer process. The weight-average molecular weight of the urea-modified polyester (i) is from 10,000 or more, preferably from 20,000 to 10,000,000, and more preferably from 30,000 to 1,000,000. If the weight-average molecular weight is less than 10,000, the hot off-set resistance may deteriorate. The number-average molecular weight of the urea-modified polyester (i) is not specifically limited when the unmodified polyester (ii) is used in combination and may be such a number-average molecular weight as to yield the above-specified weight-average molecular weight. If the urea-modified polyester (i) is used alone, the number-average molecular weight thereof is 20,000 or less, preferably from 1000 to 10,000, and more preferably from 2000 to 8000. If the number-average molecular weight is more than 20,000, the image-fixing properties at low temperatures and glossiness upon use in a full-color apparatus may deteriorate.

(Unmodified Polyesters)

In the present invention, the urea-modified polyester (i) can be used alone or in combination with an unmodified polyester (ii) as the binder component of the toner. The combination use of the urea-modified polyester (i) with the unmodified polyester (ii) may improve the image-fixing properties at low temperatures and glossiness upon use in a full-color apparatus. Therefore the combination use is preferred to using each of the urea-modified polyester (i) and the unmodified polyester (ii) alone.

Examples of the unmodified polyester (ii) include a polycondensation product of a polyol (1) having the similar components to the polyesters in the urea-modified polyester (i) and a polycarboxylic acid (2). Preferable examples of the unmodified polyester (ii) include those indicated as the preferable examples of the urea-modified polyester (i).

The unmodified polyesters (ii) include unmodified polyesters as well as polyesters modified with a chemical bond other than urea bond, such as urethane bond. The urea-modified polyester (i) and the unmodified polyester (ii) are preferably at least partially compatible or miscible with each other for better image-fixing properties at low temperatures and hot offset resistance. Accordingly, the weight ratio of the urea-modified polyester (i) to the unmodified polyester (ii) is from 5/95 to 80/20, preferably from 5/95 to 30/70, more preferably from 5/95 to 25/75, and typically preferably from 7/93 to 20/80. If the weight ratio is less than 5/95, the hot offset resistance may deteriorate, and satisfactory heat-resistance storageability and image fixing properties at low temperatures may not be obtained compatibly.

The peak molecular weight of the unmodified polyester (ii) is from 1000 to 30,000, preferably from 1500 to 10,000, and more preferably from 2000 to 8000. If the peak molecular weight is less than 1000, the heat-resistance storageability may deteriorate. If it is more than 30,000, the image-fixing properties at low temperatures may deteriorate. The hydroxyl value of the unmodified polyester (ii) is preferably 5 or more, more preferably from 10 to 120, and still more preferably from 20 to 80. If the hydroxyl value is less than 5, satisfactory heat-resistance storageability and image-fixing properties at low temperatures may not be obtained compatibly. The acid value of the unmodified polyester (ii) is from 1 to 30, and preferably from 5 to 20. The ranges of the acid value shows that high acid value is likely to result in toners with negative charge.

The glass transition temperature Tg of the binder resin for use in the present invention is from 50° C. to 70° C., and preferably from 55° C. to 65° C. If the glass transition temperature is less than 50° C., the heat-resistance storageability of the toner may deteriorate. If it is more than 70° C., the image-fixing properties at low temperatures may be insufficient. By using the urea-modified polyester resin, the toner of the present invention, even with a low glass transition temperature, shows higher heat-resistance storageability than the known polyester toners. The storage elastic modulus of the binder resin is such that the temperature TG', at which the storage elastic modulus determined at 20 Hz is 10,000 dyne/cm$^2$, is generally 100° C. or higher, and preferably from 110° C. to 200° C. If the temperature TG' is lower than 100° C., the hot offset resistance may deteriorate. The temperature (Tη), at which the viscosity of the binder resin is 1000 poises as determined at 20 Hz, is 180° C. or lower, and preferably from 90° C. to 160° C. If the temperature Tη is more than 180° C., the image-fixing properties at low temperatures may deteriorate. To obtain satisfactory image-fixing properties at low temperatures and hot offset resistance compatibly, TG' is preferably higher than Tη. In other words, the difference between TG' and Tη (TG'−Tη) is preferably 0° C. or more, more preferably 10° C. or more, and still more preferably 20° C. or more. The upper limit of the difference is not specifically limited. To obtain satisfactory heat-resistance storageability and image-fixing properties at low temperatures concurrently, the difference between Tη and Tg is preferably from 0° C. to 100° C., more preferably from 10° C. to 90° C., and still more preferably from 20° C. to 80° C.

(Coloring Agents)

Coloring agents for use in the present invention include known dyes and pigments. Examples of the dyes and pigments include carbon black, nigrosine dyes, black iron oxide, Naphthol Yellow S, Hansa Yellow (10G, 5G, G), cadmium yellow, yellow iron oxide, yellow ochre, chrome yellow, Titan Yellow, Polyazo Yellow, Oil Yellow, Hansa Yellow (GR, A, RN, R), Pigment Yellow L, Benzidine Yellow (G, GR), Permanent Yellow (NCG), Vulcan Fast Yellow (5G, R), Tartrazine Lake, Quinoline Yellow Lake, isoindolinone yellow, red oxide, red lead oxide, red lead, cadmium red, cadmium mercury red, antimony red, Permanent Red 4R, Para Red, Fire Red, parachlororthonitroaniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubine B, Brilliant Scarlet G, Lithol Rubine GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, eosine lake, Rhodamine Lake B, Rhodamine Lake Y, Alizarine Lake, Thioindigo Red B, Thioindigo Maroon, Oil Red, quinacridone red, Pyrazolone Red, Polyazo Red, Chrome Vermilion, Benzidine Orange, Perynone Orange, Oil Orange, cobalt blue, cerulean blue, Alkali Blue Lake, Peacock Blue Lake, Victoria Blue Lake, metal-free phthalocyanine blue, Phthalocyanine Blue, Fast Sky Blue, Indanthrene Blue (RS, BC), indigo, ultramarine, Prussian blue, Anthraquinone Blue, Fast Violet B, Methyl Violet Lake, cobalt violet, manganese violet, dioxazine violet, Anthraquinone Violet, chrome green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc white, and lithopone, and mixtures thereof. The content of the coloring agent is from 1% by weight to 15% by weight, and preferably from 3% by weight to 10% by weight, relative to the weight of the toner.

The coloring agent for use in the present invention may be used as a master batch combined with a resin. Such a binder resin for use in the preparation of the master batch or in kneading with the master batch includes, in addition to the modified and unmodified polyester resins, polymers of styrene and substituted styrenes such as polystyrene, poly-p-chlorostyrene, polyvinyltoluene, or the like; styrenic copolymers such as styrene-p-chlorostyrene copolymers, styrene-propylene copolymers, styrene-vinyltoluene copolymers, styrene-vinylnaphthalene copolymers, styrene-methyl acrylate copolymers, styrene-ethyl acrylate copolymers, styrene-butyl acrylate copolymers, styrene-octyl acrylate copolymers, styrene-methyl methacrylate copolymers, styrene-ethyl methacrylate copolymers, styrene-butyl methacrylate copolymers, styrene-methyl α-chloromethacrylate copolymers, styrene-acrylonitrile copolymers, styrene-vinyl methyl ketone copolymers, styrene-butadiene copolymers, styrene-isoprene copolymers, styrene-acrylonitrile-indene copolymers, styrene-maleic acid copolymers, styrene-maleic ester copolymers, or the like; poly(methyl methacrylate), poly(butyl methacrylate), poly(vinyl chloride), poly (vinyl acetate), polyethylenes, polypropylenes, polyesters, epoxy resins, epoxy polyol resins, polyurethanes, polyamides, poly(vinyl butyral), polyacrylic acid resin, rosin, modified rosin, terpene resins, aliphatic or alicyclic hydrocarbon resins, aromatic petroleum resins, chlorinated paraffin, paraffin wax, and the like. Each of these examples can be used alone or in combination.

The master batch for use in the present invention can be obtained by mixing and kneading a resin for master batch and the coloring agent with high shear force. To improve interaction between the coloring agent and the resin, an organic solvent can be used in this procedure. In addition, the master batch is preferably prepared by a "flushing process". In the flushing process, a water-based paste containing the coloring agent and water is mixed and kneaded with the resin and an organic solvent so that the coloring agent moves toward the resin, and that water and the organic solvent are removed. According to this process, a wet cake containing the coloring agent can be used as intact without drying. The materials are preferably mixed and kneaded using a triple roll mill and other high-shear dispersing devices.

(Release Agents)

The toner may further comprise wax as a release agent in addition to the binder resin and the coloring agent. Examples of the waxes for use in the present invention include known waxes including polyolefin waxes such as polyethylene waxes, and polypropylene waxes; long-chain hydrocarbon waxes such as paraffin waxes, Sasol waxes or the like; carbonyl group-containing waxes, and the like. Among them, preferred waxes are carbonyl group-containing waxes. Examples of the carbonyl group-containing waxes include, for example, polyalkanoic acid esters such as carnauba wax, montan wax, trimethylolpropane tribehenate, pentaerythritol tetrabehenate, pentaerythritol diacetate dibehenate, glycerol tribehenate, 1,18-octadecanedioldistearate; polyalkanol esters such as tristearyl trimellitate, distearyl maleate or the like; polyalkanoic acid amides such as ethylenediamine dibehenylamide, or the like; polyalkylamides such as tristearylamide trimellitate, or the like; and dialkyl ketones such as distearyl ketone, or the like. Among these carbonyl-containing waxes, preferred are polyalkanoic acid esters. The wax for use in the present invention has a melting point of 40° C. to 160° C., preferably 50° C. to 120° C., and more preferably 60° C. to 90° C. A wax with a melting point of lower than 40° C. may adversely affect the heat-resistance storageability. In contrast, a wax with a melting point more than 160° C. may often invite cold offset upon image fixing at low temperatures. The wax has a melt viscosity of preferably from 5 cps to 1000 cps, and more preferably from 10 cps to 100 cps as measured at a temperature 20° C. higher than its melting point. A wax with a melt viscosity more than 1000 cps may not satisfactorily contribute to improved hot offset resistance and image-fixing properties at low temperatures. A content of the wax in the toner is from 0% by weight to 40% by weight, and preferably from 3% by weight to 30% by weight.

(Charge Control Agent)

Charge control agent for the charge control agent particles of the present invention include known charge control agents such as nigrosine dyes, triphenylmethane dyes, chromium-containing metal complex dyes, molybdic acid chelate dyes, rhodamine dyes, alkoxyamines, quaternary ammonium salts including fluorine-modified quaternary ammonium salts, alkylamides, elementary substance or compounds of phosphorus, elementary substance or compounds of tungsten, fluorine-containing active agents, metal salts of salicylic acid, and metal salts of salicylic acid derivatives, or the like. Specific examples of the charge control agent include a nigrosine dye such as a commercially available product "Bontron 03" (Trademark) available from Orient Chemical Industries, Ltd., a quaternary ammonium salt such as a commercially available product "Bontron P-51" (Trademark) available from Orient Chemical Industries, Ltd., a metal-containing azo dye such as a commercially available product "Bontron S-34" (Trademark) available from Orient Chemical Industries, Ltd., an oxynaphthoic acid metal complex such as a commercially available product "Bontron E-82" (Trademark) available from Orient Chemical Industries, Ltd., a salicylic acid metal complex such as a commercially available product "Bontron E-84" (Trademark) available from Orient Chemical Industries, Ltd., a phenolic condensate such as a commercially available product "Bontron E-89" (Trademark) available from Orient Chemical Industries, Ltd., a quaternary ammonium salt molybdenum complex such as commercially available products "TP-302" and "TP415" (Trademark) available from Hodogaya Chemical Co. Ltd., a quaternary ammonium salt such as a commercially available product "Copy Charge PSY VP2038" (Trademark) available from Hoechst AG, a triphenylmethane derivative such as a commercially available product "Copy Blue PR" (Trademark) available from Hoechst AG, a quaternary ammonium salt such as commercially available products "Copy Charge NEG VP2036" and "Copy charge NX VP434" (Trademark) available from Hoechst AG, a boron complex such as commercially available products "LR-147" and "LRA-901" available from Japan Carlit Co., Ltd., as well as copper phthalocyanine, perylene, quinacridone, azo pigment, and polymeric compounds having a functional group such as sulfonic group, carboxyl group, quaternary ammonium salt, or the like.

The amount of the charge control agent particles is not specifically limited, can be set depending on the type of the binder resin, additives, if any, used according to necessity and the process for preparing the toner including a dispersing process. The amount of the charge control agent particles is preferably from 0.1 parts by weight to 10 parts by weight, and more preferably from 0.2 parts by weight to 5 parts by weight, relative to 100 parts by weight of the binder resin. If the amount is more than 10 parts by weight, the toner may be excessively charged, the charge control agent particles may not sufficiently plays its role, the developer may have increased electrostatic attraction to a development roller, may have decreased fluidity or may induce decrease in concentration of images. The charge control agent particles may be melted and kneaded with the master batch and the resin. Thereafter, the charge control agent particles may be dissolved and dispersed. The charge control agent particles may be added directly either during the dissolving procedure or the dispersion procedure. Moreover, the charge control agent particles may be added after the resin particles in terms of primary toner particles are formed so as to subject the charge control agent particles to be immobilized to a surface of the primary toner particles. A toner having the charge control agent particles in its surface is typically advantageously used in the present invention. As a stirring apparatus for giving charge and for surface treatment, a preferable apparatus has a vessel that is substantially spherical without cylindrical or flat inner walls and has a continuous spherical surface. This type of apparatus does not include a powder discharger or a gas discharge port other than the continuous spherical surface in the vessel. Such a continuous sphere can yield stable and high-speed gas stream without turbulence and can give uniform energy to the charge control agent particles and the resin particles. As this type of apparatus, for example, a Q mixer available from Mitsui Mining Co., Ltd. is preferred.

The surface treatment can be performed by placing resin particles containing the coloring agent and binder resin and the charge control agent particles into the stirring apparatus and stirring and mixing the agents and resin at a peripheral speed of the rotator of preferably 40 m/sec to 150 m/sec and more preferably 60 m/sec to 120 m/sec for several seconds to several ten minutes. This treatment procedure may be repeated several times to several ten times. When the resin particles and the charge control agent particles are strongly aggregative each other, the resin particles containing the coloring agent and binder resin may be solely treated at a peripheral speed of several ten meters per second in advance, to thereby increase the fluidity of the particles and then to be mixed with the particles of the charge control agent.

An external additive may be added to the particles in order to increase the fluidity. The external additive can be added according to any procedure suitable for the intended purpose. For example, the external additive may be added to the resin particles containing the coloring agent and the binder resin before the resin particles are mixed with the charge control agent particles. The external additive may also be added to the resin particles containing the coloring agent and the binder resin, together with the charge control agent particles, so as to manufacture toner particles at once. An external additive may be suitably added to the resin particles containing the coloring agent and the binder resin after being treated with the charge control agent particles. A part of external additives that improve fluidity may be added to the resin particles when the resin particles are treated with the charge control agent particles, thereafter, the lest of the external additives that improves development properties and transfer properties may be added to the resin particles after being treated with the charge controlling agent particles.

Examples of the vinyl resins include homopolymers and copolymers of vinyl monomers, such as styrene-(meth) acrylic ester resin, styrene-butadiene copolymer, (meth) acrylic acid-acrylic ester copolymer, styrene-acrylonitrile copolymer, styrene-maleic anhydride copolymer, styrene-(meth)acrylic acid copolymer, and the like.

(External Additives)

Fine inorganic particles are preferred as external additives for use in the present invention to improve the fluidity, development properties, and charge properties of the colored particles as the toner particles. The fine inorganic particles may have a primary particle diameter of preferably 5 nm to 2 μm and more preferably 5 nm to 500 nm. The fine inorganic particles preferably have a specific surface area of 20 $m^2/g$ to 500 $m^2/g$ as determined by the Baunauer-Emmerit-Teller (BET) method. The amount of the fine inorganic particles is preferably from 0.01% by weight to 5% by weight, and more preferably from 0.01% by weight to 2.0% by weight, relative to the weight of the toner.

Examples of the fine inorganic particles include particles of silica, alumina, titanium oxide, barium titanate, magnesium titanate, calcium titanate, strontium titanate, zinc oxide, tin oxide, silica sand, clay, mica, wollastonite, diatomaceous earth, chromium oxide, cerium oxide, iron oxide red, antimony trioxide, magnesium oxide, zirconium oxide, barium sulfate, barium carbonate, calcium carbonate, silicon carbide, silicon nitride, and the like.

Examples of the external additives include fine polymer particles. Examples of the polymer particles include particles of, for example, polystyrene, methacrylic ester copolymers, and acrylic ester copolymers prepared by soap-free emulsion polymerization, suspension polymerization or dispersion polymerization, and polycondensed resins or thermosetting resins such as silicone resin, benzoguanamine resin, nylon, or the like.

These fluidizing agents (plasticizers) can be treated on their surfaces to improve their hydrophobicity to thereby prevent deterioration in fluidizing properties and charge properties even at high humidity. The preferred surface treatment agents for use herein include silane coupling agents, silylating agents, silane coupling agents having a fluorinated alkyl group, organotitanate coupling agents, aluminum coupling agents, silicon oil, modified silicone oil, and the like.

Cleaning improvers to remove a residual developer on a photoconductor or a primary transferring medium after transfer include, but are not limited to, metal salts of stearic acid and other fatty acids such as zinc stearate, and calcium stearate; and fine polymer particles prepared by, for example, soap-free emulsion polymerization, such as poly (methyl methacrylate) particles and polystyrene particles. Such fine polymer particles preferably have a relatively narrow particle distribution and a volume-average particle diameter of 0.01 μm to 1 μm.

(Preparation Method of Binder Resins)

The binder resin can be prepared, for example, by the following method.

A polyol (1) and a polycarboxylic acid (2) are heated at 150° C. to 280° C. in the presence of a known esterification catalyst such as tetrabutoxy titanate, dibutyltin oxide, or the like, and produced water is removed by distillation if necessary under a reduced pressure to thereby yield a polyester having a hydroxyl group. Thereafter, the polyester is allowed to react with a polyisocyanate (3) at 40° C. to 140° C. and thereby yields a prepolymer (A) having an isocyanate group. The prepolymer (A) is allowed to react with amine (B) at 0° C. to 140° C. and thereby yields a polyester modified with a urea bond. In the reactions between the polyester and the polyisocyanate (3) and between the prepolymer (A) and the amine (B), solvents can be used according to necessity. Such solvents for use herein are solvents inert to the isocyanate (3) including aromatic solvents such as toluene, xylene, or the like; ketones such as acetone, methyl ethyl ketone, methyl isobutyl ketone, or the like; esters such as ethyl acetate, or the like; amides such as dimethylformamide, dimethylacetamide, or the like; and ethers such as tetrahydrofuran, or the like. When the polyester (ii) which is not modified with a urea bond is used in combination, the unmodified polyester (ii) is prepared in the same manner as in the polyester having a hydroxyl group. The prepared unmodified polyester (ii) is added to and dissolved in a solution of the modified polyester after completing the reaction.

(Preparation Method of Dry Toners)

Dry toners according to the present invention can be prepared, for example, by the following method. The method is not limited to the followings.

—Toner Preparation Method in Water-based Medium—

Water-based media for use in the present invention may be water alone or may be combined with another solvent that is miscible with water. Such miscible solvents include, but are not limited to, alcohols such as methanol, isopropyl alcohol, ethylene glycol, or the like; dimethylformamide; tetrahydrofuran; Cellosorves such as methyl cellosolve, or the like; and lower ketones such as acetone, methyl ethyl ketone, or the like.

The resin particles can be prepared by allowing a dispersion containing the isocyanate-containing prepolymer (A) to react with the amine (B) in the water-based medium, or by using the prepared urea-modified polyester (i). The resin particles can be prepared, for example, by adding a composition of toner materials such as the urea-modified polyester (i) or the prepolymer (A) to the water-based medium and dispersing the materials by action of shear force. The other toner components (hereinafter referred to as "toner materials") which include the coloring agent, the coloring agent master batch, the release agent, the charge control agent, and the unmodified polyester resin may be mixed with the prepolymer (A) during a dispersing procedure in the water-based medium for the formation of a dispersion. However, it is preferred that these toner materials are mixed with one another beforehand and the resulting mixture is added to the water-based medium. The other toner materials which includes the coloring agent, the release agent, and the charge control agent are not necessarily added during the formation of the toner particles in the water-based medium and can be added to the formed toner particles. For example, particles containing no coloring agent are firstly formed, and the coloring agent is then added to the formed resin particles according to a known dying method.

The dispersing method is not specifically limited and includes known methods such as low-speed shearing method, high-speed shearing method, dispersing method by friction, high-pressure jetting method, ultrasonic dispersion method, and the like. To allow the dispersion to have an average particle diameter of 2 μm to 20 μm, the high-speed shearing method is preferred. When a high-speed shearing dispersing machine is used, the number of rotation is not specifically limited and is from 1000 rpm to 30,000 rpm and preferably from 5000 rpm to 20,000 rpm. The dispersion time is not specifically limited and is from 0.1 minute to 5 minutes in a batch system. The dispersing temperature is from 0° C. to 150° C. under a pressure and preferably from 40° C. to 98° C. The dispersion is preferably performed at a relatively high temperature for lower viscosity of the dispersion containing the urea-modified polyester (i) or the prepolymer (A) and for easier dispersion.

The amount of the water-based medium is from 50 parts by weight to 2000 parts by weight, and preferably from 100 parts by weight to 1000 parts by weight, relative to 100 parts by weight of the toner composition containing the urea-modified polyester (i) or the prepolymer (A). If the amount is less than 50 parts by weight, the toner composition may not be dispersed sufficiently, which results in failing to manufacture toner particles having a set average particle diameter. If it is more than 2000 parts by weight, it is not economical. If necessary, a dispersing agent can be used. Such a dispersing agent is preferably used for a narrower particle distribution and more stable dispersion.

The urea-modified polyester (i) can be prepared from the prepolymer (A) by allowing the prepolymer (A) to react with the amine (B) before dispersing of the toner composition in the water-based medium or by dispersing the prepolymer (A) in the water-based medium and then adding the amine (B) to react at the particle interface. In this procedure, the urea-modified polyester is formed preferentially in the surface of the prepared resin particles, and the resin particles may have a concentration gradient inside the resin particles.

To emulsify and disperse an oil phase-containing the dispersed toner composition into a liquid containing water, a dispersing agent is used. Such dispersing agents include, but are not limited to, anionic surfactants such as alkylbenzene sulfonates, α-olefinsulfonates, phosphoric esters, or the like; amine salts cationic surfactants such as alkylamine salts, amino alcohol fatty acid derivatives, polyamine fatty acid derivatives, imidazoline, or the like; quaternary ammonium salts cationic surfactants such as alkyltrimethylammonium salts, dialkyldimethylammonium salts, alkyldimethylbenzylammonium salts, pyridinium salts, alkylisoquinolinum salts, benzethonium chloride, or the like; nonionic surfactants such as fatty acid amide derivatives, polyhydric alcohol derivatives, or the like; amphoteric surfactants such as alanine, dodecyl di(aminoethyl)glycine, di(octylaminoethyl) glycine, N-alkyl-N,N-dimethylammonium betaines, or the like.

The effect of the dispersing agent can be remarkably improved in a small amount by using a surfactant having a fluoroalkyl group. Preferred examples of fluoroalkyl-containing anionic surfactants include fluoroalkylcarboxylic acids each containing 2 to 10 carbon atoms, and metallic salts thereof, disodium perfluorooctanesulfonyl glutamate, sodium 3-[omega-fluoroalkyl ($C_6$–$C_{11}$)oxy]-1-alkyl ($C_3$–$C_4$) sulfonate, sodium 3-[omega-fluoroalkanoyl ($C_6$–$C_{11}$)-N-ethylamino]-1-propanesulfonate, fluoroalkyl ($C_{11}$-$C_{20}$) carboxylic acids and metallic salts thereof, perfluoroalkyl carboxylic acids ($C_7$–$C_{13}$) and metallic salts thereof, perfluoroalkyl ($C_4$–$C_{12}$) sulfonic acids and metallic salts thereof, perfluorooctanesulfonic acid diethanolamide, N-propyl-N-(2-hydroxyethyl) perfluorooctanesulfonamide, perfluoroalkyl ($C_6$–$C_{10}$) sulfonamide propyl trimethyl ammonium salts, perfluoroalkyl ($C_6$–$C_{10}$)-N-ethylsulfonyl glycine salts, monoperfluoroaklyl ($C_6$–$C_{16}$) ethyl phosphoric esters, and the like.

Such fluoroalkyl-containing anionic surfactants are commercially available under the trade names of, for example, SURFLON S-111, S-112 and S-113 (from Asahi Glass Co., Ltd.), FLUORAD FC-93, FC-95, FC-98 and FC-129 (from Sumitomo 3M Limited), UNIDYNE DS-101 and DS-102 (from Daikin Industries, Ltd.), MEGAFAC F-110, F-120, F-113, F-191, F-812 and F-833 (from Dainippon Ink & Chemicals, Incorporated), EFTOP EF-102, EF-103, EF-104, EF-105, EF-112, EF-123A, EF-123B, EF-306A, EF-501, EF-201 and EF-204 (from Tohkem Products Corporation), and FTERGENT F-100 and F-150 (from Neos Co., Ltd.).

Examples of fluoroalkyl-containing cationic surfactants for use in the present invention include aliphatic primary, secondary and tertiary amine salts each having a fluoroalkyl group; aliphatic quaternary ammonium salts such as perfluoro-alkyl ($C_6$–$C_{10}$) sulfonamide propyltrimethyl ammonium salts, or the like; benzalkonium salts; benzethonium chloride; pyridinium salts; imidazolinium salts, and the like. Such fluoroalkyl-containing cationic surfactants are commercially available, for example, under the trade names of SURFLON S-121 (from Asahi Glass Co., LTD.), FLUORAD FC-135 (from Sumitomo 3M Limited), UNIDYNE DS-202 (from Daikin Industries, LTD.), MEGAFAC F-150, and F-824 (from Dainippon Ink & Chemicals, Incorporated), EFTOP EF-132 (from Tohkem Products Corporation), and FTERGENT F-300 (from Neos Co., Ltd.).

In addition, an inorganic compound which is slightly soluble in water, such as tricalcium phosphate, calcium carbonate, titanium oxide, colloidal silica, hydroxyapatite, or the like can be also used as the dispersing agent.

In the preparation of the toner of the present invention, a polymeric protective colloid may be employed for stabilizing the primary particles in the dispersion. Examples of the polymeric protective colloid include homopolymers and copolymers of acids such as acrylic acid, methacrylic acid, α-cyanoacrylic acid, α-cyanomethacrylic acid, itaconic acid, crotonic acid, fumaric acid, maleic acid, maleic anhydride, or the like; hydroxyl-group-containing (meth)acrylic monomers such as β-hydroxyethyl acrylate, β-hydroxyethyl methacrylate, β-hydroxypropyl acrylate, β-hydroxypropyl methacrylate, γ-hydroxypropyl acrylate, 3-chloro-2-hydroxypropyl acrylate, 3-chloro-2-hydroxypropyl methacrylate, diethylene glycol monoacrylic ester, diethylene glycol monomethacrylic ester, glycerol monoacrylic ester, glycerol monomethacrylic ester, N-methylolacrylamide, N-methylolmethacrylamide, or the like; vinyl alcohol and ethers thereof such as vinyl methyl ether, vinyl ethyl ether, vinylpropyl ether, or the like; esters of vinyl alcohol and carboxyl-group-containing compound, such as vinyl acetate, vinyl propionate, vinyl butyrate, or the like; acrylamide, methacrylamide, diacetone acrylamide, methylol compounds thereof, or the like; acid chlorides such as acryloyl chloride, methacryloyl chloride, or the like; nitrogen-containing or heterocyclic compounds such as vinylpyridine, vinylpyrrolidone, vinylimidazole, ethyleneimine, or the like; polyoxyethylene compounds such as polyoxyethylene, polyoxypropylene, polyoxyethylene alkyl amines, polyoxypropylene alkyl amines, polyoxyethylene alkyl amides, polyoxypropylene alkyl amides, polyoxyethylene nonyl phenyl ether, polyoxyethylene lauryl phenyl ether, polyoxyethylene stearyl phenyl ester, polyoxyethylene nonyl phenyl ester, or the like; and cellulose and derivatives thereof such as methyl cellulose, hydroxyethyl cellulose, hydroxypropyl cellulose, or the like.

When calcium phosphate or another dispersion stabilizer that is soluble in acids or bases is used, the dispersion stabilizer is removed from the particles by dissolving the dispersion stabilizer by action of an acid such as hydrochloric acid and washing the particles. Alternatively, the dispersion stabilizer can be removed by, for example, decomposition by action of an enzyme.

When a dispersing agent is used, the dispersing agent may be allowed to remain on the surface of the resin particles but is preferably removed by washing after at least one of elongation reaction or crosslinking reaction from the viewpoint of toner charge properties.

In addition, a solvent that can solve the urea-modified polyester (i) and/or the prepolymer (A) can be used for lower viscosity of the toner composition. By using the solvent, a narrower particle distribution can be obtained. The solvent is preferably volatile and has a melting point of lower than 100° C. for easier removal. Such solvents include, but are not limited to, toluene, xylene, benzene, carbon tetrachloride, methylene chloride, 1,2-dichloroethane, 1,1,2-trichloromethane, trichloroethylene, chloroform, monochlorobenzene, dichloroethylidene, methyl acetate, ethyl acetate, methyl ethyl ketone, methyl isobutyl ketone, and the like. Each of these solvents can be used either alone or in combination of two or more. Among them, the preferred solvents are aromatic solvents such as toluene, xylene, or the like, halogenated hydrocarbons such as methylene chloride, 1,2-dichloroethane, chloroform, carbon tetrachloride, or the like. The amount of the solvent is generally from 0 to 300 parts by weight, preferably from 0 part by weight to 100 parts by weight, and more preferably from 25 parts by weight to 70 parts by weight, relative to 100 parts by weight of the prepolymer (A). The solvent, if any, is removed by heating at atmospheric pressure or under reduced pressure after the elongation and/or crosslinking reaction.

The reaction time for elongation and/or crosslinking is appropriately set depending on the reactivity derived from the combination of the isocyanate structure of the prepolymer (A) and the amine (B) and is from 10 minutes to 40 hours and preferably from 2 hours to 24 hours. The reaction temperature is from 0° C. to 150° C. and preferably from 40° C. to 98° C. If necessary, a known catalyst such as dibutyltin laurate, dioctyltin laurate, or the like can be used.

The organic solvent can be removed from the prepared emulsion, for example, by gradually elevating the temperate of the entire system and completely removing the organic solvent in the primary particles by evaporation. Alternatively, it can be removed by spraying the emulsion into a dry atmosphere, thereby completely removing the non-water-soluble organic solvent in the primary particles to thereby form fine resin particles while removing the water-based dispersing agent by evaporation. The dry atmosphere to which the emulsion is sprayed includes, for example, heated gases such as air, nitrogen gas, carbon dioxide gas, and combustion gas. The gas is preferably heated to a temperature higher than the boiling point of a solvent having the highest boiling point. A desired product can be obtained by short-time drying using a dryer such as spray dryer, belt dryer or rotary kiln.

When the particle distribution of the primary particles is wide and the adjustment of the particle distribution is not carried out in the washing and drying processes, the particles in the emulsion may be classified, so as to stabilize the particle distribution.

The particles can be classified by removing particle fractions using a cyclone, decanter or centrifugal separator in a liquid. As a matter of course, it is possible to classify the particles after drying into a powder. However, to classify the particles in the dispersion (in a liquid) is more efficient. The removed unnecessary particles or coarse particles can be left wet.

It is preferable to remove the employed dispersing agent as much as possible from the dispersion. This removing operation is preferably simultaneously carried out with the aforementioned classification operation.

The dried resin powder particles are typically and preferably mixed with the charge control agent particles to form toner particles. By this procedure, the amount of the charge control agent particles in the surface of the toner particles can be easily controlled to be the M/T ratio of the present invention.

In the mixing operation, the resin particles can be mixed with finely-divided particles of various agents such as a release agent, a fluidity-imparting agent, and a coloring agent. By the application of mechanical impact to the thus obtained mixture of particles, those finely-divided particles of various agents can be fixed on the surface of the toner particles or uniformly blended with the toner particles on the surface thereof. Thus, the particles of various agents disposed onto the surface of the toner particles can be prevented from eliminating.

To be more specific, examples of concrete procedures are the method of applying the impact to the mixed particles using a blade rotating at high revolution, and the method of putting the mixed particles into an air stream flowing at a high speed, and making the particles come into collision and the obtained composite particles strike against a proper plate by accelerating the air stream. For example, there can be employed a commercially available powder surface modification system, "Ang mill" (Trademark) available from Hosokawa Micron Corporation; a system obtained by modifying "Impact Mill" (Trademark) available from Nippon Pneumatic Mfg. Co., Ltd. by descending the air pressure for pulverizing; a system "Hybridization System" (Trademark) available from Nara Machinery Co., Ltd.; and a system "Kryptron System" (Trademark) available from Kawasaki Heavy Industries, Ltd.; and an automatic mortar.

—Carriers for Two-Component Developers—

The toner of the present invention can be used in a two-component developer with a magnetic carrier. The content of the toner in the developer is preferably from 1 part by weight to 10 parts by weight relative to 100 parts by weight of the carrier. Examples of the magnetic carriers include conventional magnetic particles having a particle diameter of about 20 μm to about 200 μm. The conventional magnetic particles are made of powdery iron, powdery ferrite, powdery magnetite, magnetic resins, and the like.

Coating materials for use herein include, but are not limited to, amine resins such as urea-formaldehyde resins, melamine resins, benzoguanamine resins, urea resins, polyamide resins, epoxy resins, or the like; polyvinyl and polyvinylidene resins such as acrylic resins, poly(methyl methacrylate) resins, polyacrylonitrile resins, poly(vinyl acetate) resins, poly(vinyl alcohol) resins, poly(vinyl butyral) resins, polystyrene resins, styrene-acrylic copolymer resins, and the like; halogenated olefin resins such as poly(vinyl chloride) or the like; poly(ethylene terephthalate) resins; polyester resins such as poly(butylene terephthalate) resins, or the like; polycarbonate resins; polyethylene resins; poly(vinyl fluoride) resins; poly(vinylidene fluoride) resins; polytrifluoroethylene resins; polyhexafluoropropylene resins; copolymers of vinylidene fluoride and acrylic monomer; vinylidene fluoride-vinyl fluoride copolymers; fluoroterpolymers such as terpolymers of tetrafluoroethylene, vinylidene fluoride, a non-fluorinated monomer, or the like; silicone resins, and the like. The resin for use in the coating material may further comprise a conductive powder, if necessary.

Examples of the conductive powders include powders of metals, carbon black, titanium oxide, tin oxide, zinc oxide, and the like. The conductive powder for use in the present invention preferably has an average particle diameter of 1 μm or less. If the average particle diameter is more than 1 μm, the electric resistance of the developer may not sufficiently be controlled.

(Image-Forming Apparatus)

The image-forming apparatus of the present invention comprises at least a latent electrostatic image support, an image-developer which contains a developer comprising the toner of the present invention, and a developer-bearing member having a development sleeve on an outermost surface there of and carries a developer on a surface thereof. In the image-forming apparatus of the present invention, the developer-bearing member has at least a main magnetic pole which contribute to form magnetic brushes using the developer. When the developing sleeve has a point "A" on a surface thereof and on a normal based on the main magnetic pole, and has a point "B" being 1 mm distant from the point "A" in a direction of the normal to the surface thereof, the point "B" has an attenuated magnetic flux density of 0 to 40 with respect to a magnetic flux density of 100 on the point "A". Moreover, the main magnetic pole has a half width, namely an angle formed between points on a magnetic flux density distribution of the main magnetic pole and at a half value of a maximum magnetic force of the main magnetic pole, is 5° to 8°. Furthermore, the developer is transported at a liner velocity of 150 mm/sec to 500 mm/sec. In the present invention, the term "image-developer" refers a device is utilized for developing a latent electrostatic image on a latent electrostatic image support, using a developer.

(Image-Forming Process)

The image-forming process of the present invention is carried out by using the image-forming apparatus of the present invention, and comprises at least following steps. The first step is to transport the developer of the present invention onto a latent electrostatic image support by a development sleeve, which is disposed on an outermost surface of a developer-bearing member. The second step is to subject the developer contact onto a surface of the latent electrostatic image support so as to develop the latent electrostatic image.

The image-forming process according to the present invention will be described with reference to the figures. In the figures, the same number refers the same member. However, the present invention is not necessary to be limited therewith.

FIG. 1 is a sectional view of an image-forming apparatus. The image-forming apparatus includes a photoconductor drum 1 serving as a latent electrostatic image support, and also includes a charge roller 2, a light-irradiator 3, an image-developer 4, a transfer belt 6, a cleaner 8, a charge eliminating lamp 9, and an optical sensor 10, in the vicinity of or in contact with the photoconductor drum 1. The charge roller 2 serves for applying electric charges uniformly to the photoconductor drum 1. The light-irradiator 3 serves as a device for exposure, for forming a latent electrostatic image on the photoconductor drum 1. The image-developer 4 serves for developing the latent electrostatic image so as to form a toner image. The transfer belt 6 serves for transferring the toner image on to a transfer material (a recording medium). The cleaner 8 serves for removing residual toners on the photoconductor drum 1. The charge eliminating lamp 9 serves for removing residual charge on the photoconductor drum 1. The optical sensor 10 serves for controlling the applied voltage of the charge roller and the toner concentration in a developing step. The image-forming apparatus further includes a toner supplier (not shown in the figure) which serves for supplying toners through a toner supply port to the image-developer 4.

The image-forming apparatus is operated as follows:

The photoconductor 1 rotates in a counterclockwise direction. The photoconductor 1 is discharged by the charge eliminating lamp 9 and is uniformly charged at a standard surface potential of 0V to −150 V. Thereafter, the photoconductor 1 is charged by the charge roller 2 so as to have a surface potential of about −1000 V and is then exposed to light using the light-irradiator 3. The exposed areas (image-forming areas) has a surface potential of 0 to −200 V, accordingly. The toners on the sleeve are disposed onto the image-forming area by action of the image-developer 4 to form a toner image. As the photoconductor 1 having the toner image on a surface thereof rotationally moves, a transfer paper (a recording medium) is provided from a paper feed unit 5 so that the front end of the transfer paper is met with the front end of the toner image on the transfer belt 6. The toner image on the surface of the photoconductor 1 is transferred onto the transfer paper provided on the transfer belt 6. The transfer paper is transported to an image-fixing unit 7, the toner is fused and fixed onto the transfer paper by action of heat and pressure, and is ejected as a photocopy. Residual toners on the photoconductor 1 are scraped off by the cleaning blade 8, and residual charge on the photoconductor 1 is then eliminated by the charge eliminating lamp 9. Accordingly, the photoconductor 1 becomes an initial state and is subjected to a subsequent cycle of image-forming operations.

(Image-Forming Process Cartridge)

The image-forming process cartridge of the present invention comprises at least one of a latent electrostatic image support, a charger configured to charge the latent electrostatic image support uniformly, a cleaner to clean the surface of the latent electrostatic image support, and an image-developer configured to supply a developer onto a latent electrostatic image so as to visualize and develop the latent electrostatic image, and then form a toner image. The image-forming process cartridge of the present invention is formed in once-piece construction, and is attachable to and detachable from an image-forming apparatus. The image-developer is configured to contain the toner for electrophotography of the present invention.

The image-forming process cartridge of the present invention shows sufficient antioffset performance when attached into an image-forming apparatus in which lubricant oil is not applied, or is applied in a very small amount, on a fixing roller.

Figure 6:
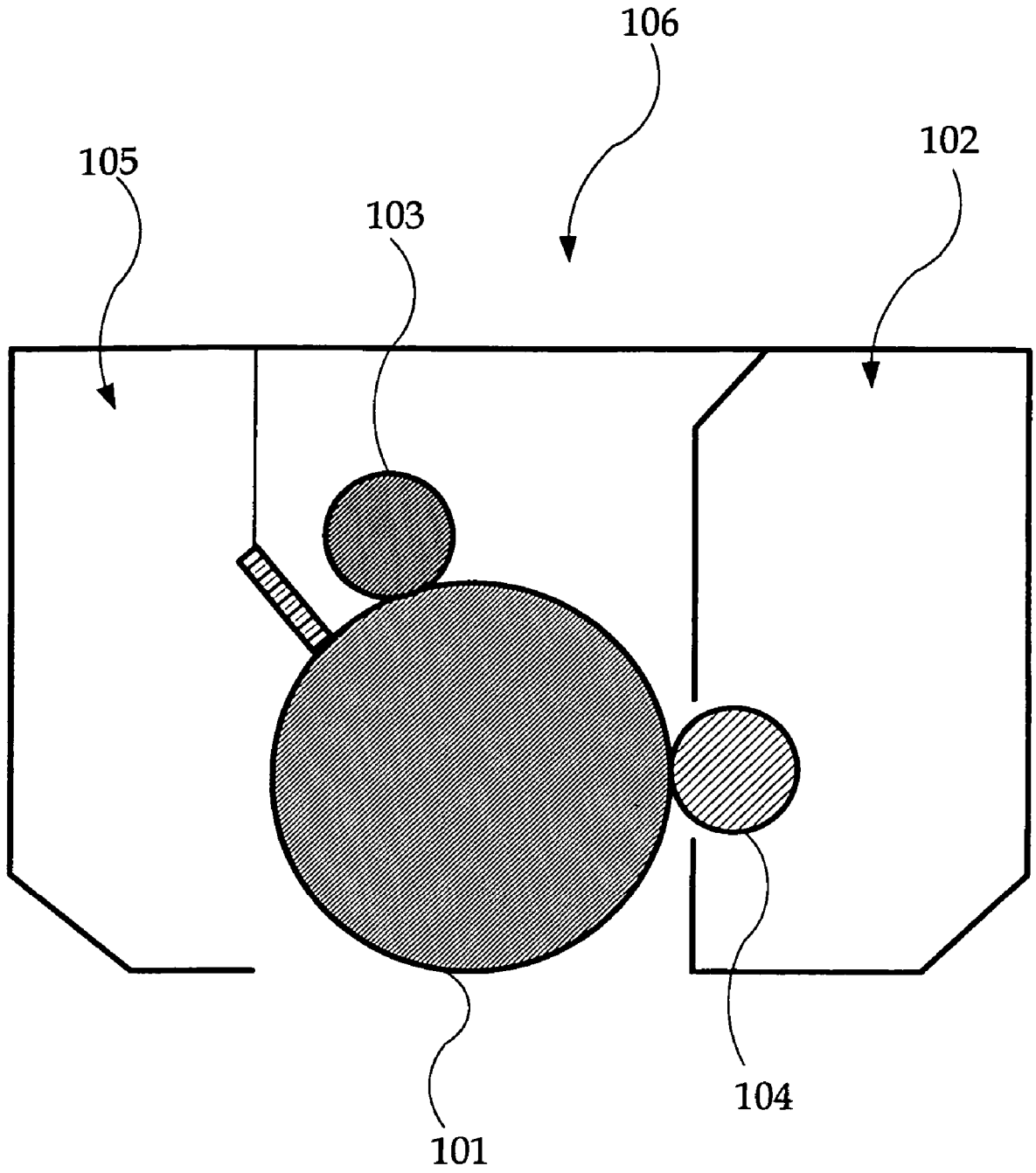
FIG. 6 is a diagram showing an example of the image-forming process cartridge of the present invention.

FIG. 6 shows an example of an image forming process unit (process cartridge). The image forming process unit 106 includes a photoconductor drum 101 serving as the latent electrostatic image support, a charge roller 103 serving as the charger, a cleaner 105 serving as the cleaner, and an image-developer 102 serving as a developing device. The image-forming process unit 106 (image-forming process cartridge) is formed in one-piece construction, and is attachable to and detachable from a printer or a copier. The image-developer 102 includes a developer-bearing member 104.

EXAMPLES

The image-forming apparatus and the image-forming process using the image-forming apparatus of the present invention will be described in further detail with reference to Examples and Comparative Examples below. The present invention is not limited to the Examples and Comparative Examples. Hereinafter, "part(s)" refers to "part(s) by weight," unless indicated.

Preparation Example 1

Preparation of Binder Resin

In a reactor equipped with a cooling tube, a stirrer, and a nitrogen supply tube, 724 parts of bisphenol A-ethylene oxide adduct 2 moles, 276 parts of isophthalic acid, and 2 parts of dibutyltin oxide were placed. The resulting mixture was allowed to react at 230° C. under atmospheric pressure for 8 hours. Thereafter, the mixture was further reacted under a reduced pressure of 10 mmHg to 15 mmHg for 5 hours. The reaction mixture was cooled to 160° C. and 32 parts of phthalic anhydride was added therein for 2 hours. The reaction mixture was further cooled to 80° C., was reacted with 188 parts of isophorone diisocyanate in ethyl acetate for 2 hours. An "isocyanate-containing prepolymer 1" was hence prepared. A total of 267 parts of the isocyanate-containing prepolymer 1 was allowed to react with 14 parts of isophoronediainine at 50° C. for 2 hours. An "urea-modified polyester 1" having a weight-average molecular weight of 64,000 was hence prepared.

A total of 724 parts of bisphenol A-ethylene oxide adduct 2 moles was subjected to polycondensation with 276 parts of terephthalic acid at 230° C. for 8 hours and then to a reaction under a reduced pressure of 10 mmHg to 15 mmHg for 5 hours. An unmodified polyester (a) having a peak molecular weight of 5000 was hence prepared. A total of 200 parts of the urea-modified polyester 1 and 800 parts of the unmodified polyester (a) were dissolved in 2000 parts of a 1:1 mixture of ethyl acetate and methyl ethyl ketone (MEK) A solution of a binder resin 1 in ethyl acetate-MEK was hence prepared. A part of the solution was dried under reduced pressure, and the binder resin 1 was separated from the ethyl acetate-MEK. The binder resin 1 had Tg of 62° C.

Example 1

Preparation of Toner

In a beaker, 240 parts of the solution of the binder resin 1 in ethyl acetate-MEK, 20 parts of pentaerythritol tetrabehenate (melting point: 81° C., melt viscosity: 25 cps), 1.6 parts of Phthalocyanine Green, and 8 parts of a carbon black pigment (available from Mitsubishi Chemical Corporation under the trade name of MA 60) were placed. The mixture was stirred using a T.K. HOMO MIXER (a product of Tokushu Kika Kogyo Co., Ltd.) at 60° C. and at 12,000 rpm. The mixture was then uniformly dissolved and dispersed, so as to prepare a solution of the toner materials.

In another beaker, 706 parts of ion-exchanged water, 294 parts of a 10% suspension of hydroxyapatite (available from Nippon Chemical Industrial Co., Ltd. under the trade name of "Supertite 10") and 0.2 parts of sodium dodecylbenzenesulfonate were placed and dissolved uniformly, so as to manufacture a mixture. After heating the mixture to 60° C., the solution of toner materials was introduced into the mixture, while stirring in a T.K. HOMO MIXER at 12,000 rpm. The resulting mixture was stirred for further 10 minutes. The mixture was then transferred to a flask equipped with a stirring rod and a thermometer, and was then heated to 98° C. to remove the solvent. After filtering, washing and drying, the resulting mixture was subjected to air classification. Colored powdery particles having a volume-average particle diameter of 6 mm were hence obtained.

Thereafter, 100 parts of the above-prepared colored powdery particles and 0.2 part of a charge control agent particles ("Bontron E-84" (a zinc complex) available from Orient Chemical Industries, Ltd.) were placed in a Q mixer (available from Mitsui Mining Co., Ltd.), and were then mixed at a peripheral speed of a turbine blade of 50 m/sec for a total of 10 minutes by repeating a cycle of 2-minutes operation and 1-minute non-operation five times, so as to prepare toner particles. In the treated charge control agent particles, the ratio M/T of the amount M (% by weight) of zinc in the surface of the treated charge control agent particle (toner particles) as measured by XPS to the amount T (% by weight) of zinc in the entire portion of the toner particle was 25.

Next, the treated charge control agent particles were then further treated with 0.5% by weight of hydrophobic silica which serves as an external additive (available from Clariant Japan Co., Ltd. under the trade name of E2000) with stirring at a peripheral speed of 15 m/sec, so as to manufacture the toner of the present invention. The toner had a volume-average particle diameter of 6.20 μm and had toner particles with a particle diameter of 10.1 μm or more in an amount of 1.0% by weight and toner particles with a particle diameter of 3.17 μm or less in an amount of 3.10% by number.

The average particle diameter and the particle distribution of the toner particles were determined in the following manner. These parameters can be determined by, for example, a Coulter Counter (trademark) Model TA-II or a Coulter Multisizer (trademark) (both available from Beckman Coulter Inc.). In the present invention, the Multisizer (available from Beckman Coulter Inc.), an interface (available from Nikkaki Bios Co., Ltd.) for output of a number distribution and a volume distribution, and a personal computer (available from NEC Corporation under the trade name of PC 9801) attached thereto were used. In addition, 1% NaCl aqueous solution was prepared from an extra pure (first grade) sodium chloride and was used as an electrolyte. As the electrolyte, a commercially available electrolyte such as ISOTON-II (available from Beckman Coulter, Inc.) or the like can also be used.

In the measurement, a measuring liquid was prepared by incorporating 0.5 ml to 5 ml of a surfactant, preferably an alkylbenzene sulfonate salt, as a dispersing agent and 2 mg to 20 mg of a test toner in 100 ml to 150 ml of the above electrolyte solution. The solution having the test toner suspended therein was dispersed in an ultrasonic dispersing device for about 1 minute to 3 minutes. By using the Coulter Multisizer tester with an aperture tube set at 100 μm, the volume and number of toner particles with a particle diameter of 2 μm or more were measured, from which the volume and particle distributions were given, and then a weight-average particle diameter of the toner was determined. Then, the volume-average particle diameter based on the volume distribution, the percentage by weight of coarse particles (with a particle diameter of 10.1 μm or more) based on the volume distribution, and the percentage by number of particles (with a particle diameter of 3.17 μm or less) based on the number distribution were determined.

Example 2

Preparation of Toner

Colored powdery particles before treatment with a charge control agent particles were prepared by the procedure of Example 1.

Then, 100 parts of the above-prepared coloring agent particles and 0.6 part of a charge control agent particles ("Bontron E-84" (a zinc complex) available from Orient Chemical Industries, Ltd.) were placed in a Q mixer (available from Mitsui Mining Co., Ltd.) and were mixed at a peripheral speed of a turbine blade of 75 m/sec for a total of 10 minutes by repeating a cycle of 2-minutes operation and 1-minute non-operation five times. In the prepared charge control agent particles, the ratio M/T of the amount M (% by weight) of zinc in the surface of the toner particle as determined by XPS to the amount T (% by weight) of zinc in the entire portion of the toner particle was 460.

Comparative Example 1

Preparation of Toner

Colored powdery particles before treatment with a charge control agent particles were prepared in the same manner as in Example 1.

100 parts of the above-prepared coloring agent particles and 0.6 part of charge control agent particles ("Bontron E-84" (a zinc complex) available from Orient Chemical Industries, Ltd.) were placed in a Q mixer (available from Mitsui Mining Co., Ltd.) and were mixed at a peripheral speed of a turbine blade of 75 m/sec for a total of 10 minutes by repeating a cycle of 2-minutes operation and 1-minute non-operation five times. In the prepared treated charge control agent particles, the ratio M/T of the amount M (% by weight) of zinc in the surface of the toner particle as determined by XPS to the amount T (% by weight) of Zinc in the entire portion of the toner particle was 570.

Comparative Example 2

Preparation of Toner

In a mixer, 100 parts of the above-prepared binder resin 1, 2 parts of Phthalocyanine Green, 10 parts of a carbon black pigment (available from Mitsubishi Chemical Corporation under the trade name of MA 60), and 2 parts of a charge control agent particles ("Bontron E-84" (a zinc complex) available from Orient Chemical Industries, Ltd.) were mixed. The mixture was further fused and kneaded in a double-roll mill, and the kneaded product was pressed and cooled. The cooled product was pulverized, using an impact-type jet mill (available from Nippon Pneumatic MPG. Co., Ltd. under the trade name of "Impact Mill"). The product was then classified with an air classifier of spiral flow type (DS classifier, available from Nippon Pneumatic MFG. Co., Ltd.). Colored particles were hence obtained. In the prepared colored toner particles, the ratio M/T of the amount M (% by weight) of zinc in the surface of the toner particle as determined by XPS to the amount T (% by weight) of Zinc in the entire portion of the toner particle was 15.

Next, the above-prepared particles were then treated with 0.5% by weight of hydrophobic silica (available from Clariant Japan Co., Ltd. under the trade name of H2000) which serves as an external additive with stirring at a peripheral speed of 15 m/sec, so as to manufacture the toner of the present invention. The toner had a volume-average particle diameter of 6.25 μm and had particles with a particle diameter of 10.1 μm or more in an amount of 1.5% by weight and particles with a particle diameter of 3.17 μm or less in an amount of 4.10% by number.

A series of developers was prepared using 5% by weight of each of the toner particles treated with the external additive and 95% by weight of a copper-zinc ferrite carrier coated with a silicone resin and having an average particle diameter of 40 μm. The developers were subjected to a test under the following conditions using a modified model of a commercially available printing and copying apparatus, Imagio Neo 450 (available from Ricoh Company Ltd.), capable of printing 45 sheets of A4 paper per minute.

Condition 1: At a linear velocity of the development sleeve of 250 mm/sec and a toner concentration of 3%

Condition 2: At a linear velocity of the development sleeve of 350 mm/sec and a toner concentration of 3%

Condition 3: At a linear velocity of the development sleeve of 350 mm/sec and a toner concentration of 3%, except with a SLIC development unit replacing the developing unit of the printing and copying apparatus Condition 4: At a linear velocity of the development sleeve of 250 mm/sec and a toner concentration of 5%

Under these conditions, the developers were tested in which the apparatus was allowed to print images on 10,000 sheets of A4 sized paper at an image density of 7% and was then allowed to output a standard chart. The solid image density, thin line reproducibility, and scattering of toner particles in the apparatus were then rated according to five ranks.

The higher the rating is, the more excellent the property is. Ranks 4 and 5 express satisfactory properties.

In Table 1, A is the black image density, B is the thin line reproducibility, and C is the scattering of toner particles in the apparatus.

TABLE 1

| | Condition 1 | | | Condition 2 | | | Condition 3 | | | Condition 4 | | |
|---|---|---|---|---|---|---|---|---|---|---|---|---|
| | A | B | C | A | B | C | A | B | C | A | B | C |
| Example 1 | 5 | 5 | 5 | 4 | 4 | 5 | 4 | 5 | 5 | 5 | 5 | 5 |
| Example 2 | 5 | 5 | 5 | 4 | 4 | 5 | 4 | 5 | 5 | 5 | 5 | 5 |
| Comp. Ex. 1 | 4 | 4 | 5 | 2 | 2 | 5 | 3 | 3 | 2 | 3 | 2 | 3 |
| Comp. Ex. 2 | 4 | 4 | 4 | 1 | 3 | 2 | 3 | 3 | 1 | 2 | 1 | 1 |

The toners of the present invention can effectively prevent scattering of the toner from the developer-bearing member and can yield very high quality images in any of image-developers that are used at a linear velocity of the developer-bearing member of 150 mm/sec to 500 mm/sec, those used in the SLIC development system in which magnetic blush forms at a higher speed than conventional developer-bearing members, and those used at a toner concentration in a developer of 4% by weight or more.

What is claimed is:

1. An image-forming process comprising the steps of:

transporting a developer onto a latent electrostatic image support with a development sleeve disposed on an outermost surface of a developer-bearing member; and subjecting the developer to contact onto a surface of the latent electrostatic image support so as to develop a latent electrostatic image thereon, wherein the developer bearing member has at least a main magnetic pole for forming magnetic brushes, where the latent electrostatic image support and the development sleeve come to close to each other with the shortest distance, when the developing sleeve has a point "A" on a surface thereof and on a normal based on the main magnetic pole, and has a point "B" being 1 mm distant from the point "A" in a direction of the normal to the surface thereof, the point "B" has an attenuated magnetic flux density of 0 to 40 with respect to a magnetic flux density of 100 on the point "A,"

a half width of a magnetic flux density distribution curve of the main magnetic pole, is 5° to 20°, the developer is transported at a linear velocity of 150 mm/sec to 500 mmlsec, and the developer contains a toner which comprises:

a resin particle; and a charge control agent particle, mixed with the resin particle so as to form a toner particle of the toner, wherein a ratio (M/T) of an amount M (% by weight) of an element in a surface of the toner particle to an amount T (% by weight) of an element in an entire portion of the toner particle is 20 to 500, the element is contained only within the charge control agent particle, and the element is selected from the first period to the fifth period in a long form of periodic table, excluding a hydrogen element, a carbon element, an oxygen element, and rare gas elements, wherein the resin particle contains a toner composition comprising at least a binder resin and a coloring agent, wherein the resin particle is obtained by one of dispersing or dissolving the toner composition in an organic solvent so as to form one of a toner composition dispersed in the solvent and a toner composition dissolved in the solvent, thereafter dispersing the dissolved or dispersed toner composition in an aqueous solution so as to form an emulsion, and removing the solvent of the emulsion so as to form the resin particle.

2. An image-forming process according to claim 1, wherein the developer contains 4% by weight or more of the toner.

3. An image-forming process according to claim 1, wherein the ratio M/T is 40 to 300.

4. An image-forming process according to claim 1, wherein the binder resin is modified polyester.

5. An image-forming process according to claim 4, wherein the modified polyester is a reaction product of polyester prepolymer and amine.

6. An image-forming process according to claim 4, wherein the binder resin further comprises unmodified polyester.

7. An image-forming process according to claim 6, wherein a weight ratio of the modified polyester to the unmodified polyester (the modified polyester/the unmodified polyester) is 5/95 to 80/20.

8. An image-forming process according to claim 1, wherein the binder resin has a glass transition temperature of 50° C. to 70° C.

9. An image-forming process, comprising:

transporting a developer onto a latent electrostatic image support with a development sleeve disposed on an outermost surface of a developer-bearing member; and subjecting the developer to contact onto a surface of the latent electrostatic image support so as to develop a latent electrostatic image thereon, wherein the developer bearing member has at least a main magnetic pole for forming magnetic brushes, where the latent electrostatic image support and the development sleeve come to close to each other with the shortest distance;

when the developing sleeve has a point "A" on a surface thereof and on a normal based on the main magnetic pole, and has a point "B" being 1 mm distant from the point "A" in a direction of the normal to the surface thereof, the point "B" has an attenuated magnetic flux density of 0 to 40 with respect to a magnetic flux density of 100 on the point "A,"

a half width of a magnetic flux density distribution curve of the main magnetic pole, is 5° to 20°;

the developer is transported at a linear velocity of 150 mm/sec to 500 mmlsec; and the developer contains a toner which comprises:

a resin particle containing a toner composition comprising at least a binder resin and a coloring agent; and a charge control agent particle, mixed with the resin particle so as to form a toner particle of the toner; and wherein a ratio (M/T) of an amount M (% by weight) of an element in a surface of the toner particle to an amount T (% by weight) of an element in an entire portion of the toner particle is 20 to 500, the element is contained only within the charge control agent particle, and the element is selected from the first period to the fifth period in a long form of periodic table, excluding a hydrogen element, a carbon element, an oxygen element, and rare gas elements.

10. An image-forming process according to claim 9, wherein the developer contains 4% by weight or more of the toner.

11. An image-forming process according to claim 9, wherein the ratio M/T is 40 to 300.

12. An image-forming process according to claim 9, wherein the binder resin is modified polyester.

13. An image-forming process according to claim 12, wherein the modified polyester is a reaction product of polyester prepolymer and amine.

14. An image-forming process according to claim 12, wherein the binder resin further comprises unmodified polyester.

15. An image-forming process according to claim 14, wherein a weight ratio of the modified polyester to the unmodified polyester (the modified polyester/the unmodified polyester) is 5/95 to 80/20.

16. An image-forming process according to claim 9, wherein the binder resin has a glass transition temperature (Tg) of 50° C. to 70° C.

* * * * *